US008741529B2

(12) United States Patent
Aoki et al.

(10) Patent No.: US 8,741,529 B2
(45) **Date of Patent: *Jun. 3, 2014**

(54) IMAGE FORMING METHOD, IMAGE FORMING APPARATUS, AND PROCESS CARTRIDGE

(75) Inventors: Mitsuo Aoki, Shizuoka (JP); Hisashi Nakajima, Shizuoka (JP); Masashi Nagayama, Shizuoka (JP); Saori Yamada, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/419,843

(22) Filed: Mar. 14, 2012

(65) Prior Publication Data

US 2012/0251169 A1 Oct. 4, 2012

(30) Foreign Application Priority Data

Apr. 1, 2011 (JP) ..... 2011-081626

(51) Int. Cl.
*G03G 13/08* (2006.01)
*G03G 13/20* (2006.01)

(52) U.S. Cl.
USPC ..... 430/123.53; 430/109.4; 430/124.1

(58) Field of Classification Search
USPC ..... 430/109.1, 109.4, 123.53, 124.1
See application file for complete search history.

(56) References Cited

U.S. PATENT DOCUMENTS

| | | | | |
|---|---|---|---|---|
| 7,521,164 | B2 | 4/2009 | Nakayama et al. | |
| 7,566,521 | B2 | 7/2009 | Kotsugai et al. | |
| 7,608,377 | B2 | 10/2009 | Nakayama et al. | |
| 7,985,518 | B2 | 7/2011 | Shu et al. | |
| 8,086,143 | B2 | 12/2011 | Nagayama et al. | |
| 2008/0073252 | A1 | 3/2008 | Yamaguchi et al. | |
| 2008/0213682 | A1 | 9/2008 | Saitoh et al. | |
| 2008/0233498 | A1 | 9/2008 | Yamada et al. | |
| 2009/0068579 | A1 | 3/2009 | Ogawa et al. | |
| 2009/0142678 | A1 | 6/2009 | Yagi et al. | |
| 2009/0186290 | A1* | 7/2009 | Yoshizaki et al. | 430/109.1 |
| 2010/0068644 | A1 | 3/2010 | Nakajima et al. | |
| 2010/0136471 | A1 | 6/2010 | Yamada et al. | |
| 2010/0183966 | A1* | 7/2010 | Kadokura et al. | 430/107.1 |

(Continued)

FOREIGN PATENT DOCUMENTS

| | | |
|---|---|---|
| JP | 4-278967 | 10/1992 |
| JP | 4-338984 | 11/1992 |

(Continued)

*Primary Examiner* — Stewart Fraser
(74) *Attorney, Agent, or Firm* — Oblon, Spivak, McClelland, Maier & Neustadt, L.L.P.

(57) ABSTRACT

An image forming method including forming an electrostatic latent image on an image bearing member; developing the electrostatic latent image using a color toner and a transparent toner to form a color toner image and a transparent toner image thereon; transferring the color toner image and the transparent toner image to a recording material; and fixing the color toner image and the transparent toner image on the recording material. The color toner includes a polyester resin and a colorant, and the loss tangent of the color toner has a maximum peak at a temperature of from 80° C. to 160° C., and is not greater than 3 at the maximum peak. The transparent toner includes a crystalline polyester resin, and the loss tangent of the transparent toner has a maximum peak at a temperature of from 80° C. to 160° C., and is not less than 3 at the maximum peak.

6 Claims, 3 Drawing Sheets

(56) References Cited

U.S. PATENT DOCUMENTS

| | | | | |
|---|---|---|---|---|
| 2011/0081608 | A1* | 4/2011 | Yaguchi et al. | 430/105 |
| 2011/0165508 | A1 | 7/2011 | Nakayama et al. | |
| 2011/0170915 | A1 | 7/2011 | Aoki et al. | |
| 2012/0009514 | A1* | 1/2012 | Nagayama et al. | 430/105 |
| 2012/0009518 | A1* | 1/2012 | Nagayama et al. | 430/124.1 |
| 2012/0028183 | A1 | 2/2012 | Nakajima et al. | |

FOREIGN PATENT DOCUMENTS

| | | |
|---|---|---|
| JP | 4-362960 | 12/1992 |
| JP | 5-158364 | 6/1993 |
| JP | 8-220821 | 8/1996 |
| JP | 9-200551 | 7/1997 |
| JP | 2009-109926 | 5/2009 |

* cited by examiner

IMAGE FORMING METHOD, IMAGE FORMING APPARATUS, AND PROCESS CARTRIDGE

CROSS-REFERENCE TO RELATED APPLICATIONS

This patent application is based on and claims priority pursuant to 35 U.S.C. §119 to Japanese Patent Application No. 2011-081626 filed on Apr. 1, 2011 in the Japan Patent Office, the entire disclosure of which is hereby incorporated herein by reference.

FIELD OF THE INVENTION

The present invention relates to an image forming method for forming images using a transparent toner and a color toner. In addition, the present invention also relates to an image forming apparatus and a process cartridge, which form images using a transparent toner and a color toner.

BACKGROUND OF THE INVENTION

Electrophotographic image forming methods used for dry image forming apparatuses such as laser printers, copiers and facsimiles typically include the following processes:

(1) charging a surface of an image bearing member such as a photoreceptor (charging process);
(2) irradiating the charged surface of the image bearing member with light so that the charges of the irradiated portions decay, thereby forming an electrostatic latent image on the surface of the image bearing member (irradiating process);
(3) developing the electrostatic latent image with a developer including a charged dry toner to form a visible toner image on the image bearing member (developing process);
(4) transferring the toner image to a recording material such as a paper sheet (transferring process);
(5) fixing the toner image to the recording material upon application of heat and/or pressure (fixing process); and
(6) cleaning the surface of the image bearing member so that the image bearing member is ready for the next image forming operation.

Recently, there is an increasing need for an image forming apparatus capable of performing high speed image formation while saving fixing energy. Therefore, there is a need for toner capable of melting at a relatively low temperature.

Further, recent image forming apparatuses are required to produce high quality images. Therefore, for example, when a pictorial image is formed, a technique in that high glossiness is imparted to the surface of a recording material is used to produce a clear glossy image.

In order to impart high glossiness to the surface of a recording material, a technique in that a transparent toner is applied to a non-image area of a recording material bearing a color image thereon to decrease the difference in glossiness between the color image area and the non-image area; a technique in that a transparent toner is applied to the entire surface of a recording material; and the like techniques have been proposed.

In addition, a technique in that a color toner image and a transparent toner image are formed on a recording material, and the images are heated by a fixing device, followed by cooling and peeling the images from the fixing device to prepare a glossy image is proposed. Using these techniques make it possible to produce copies having little difference in glossiness between an image area and a non-image area.

By contrast, in the printing field, treatments such as UV varnish printing, varnishing, and polypropylene film laminating are performed to control the glossiness of a desired portion of a printed image on a recording material. For example, a technique in that after performing a usual printing operation, an additional spot printing operation is performed on a desired portion of the print using an additionally prepared plate and an UV varnish or the like to impart high glossiness to the portion is used. By using this technique, a print in which the portion subjected to the spot printing operation has as high glossiness as photographs and other portions thereof have relatively low glossiness can be produced. Namely, the print has large glossiness difference, and therefore the print can be differentiated from normal prints.

However, when such a print is produced using an offset printing method, it is necessary to prepare an additional plate for forming such a glossy portion. In addition, this method cannot be used for producing a small number of prints (e.g., prints which are similar but a part of which is different from each other) due to increase of running costs, i.e., the method can be used only for producing a large number of prints.

Since electrophotography can perform image formation without using a plate, it becomes possible to produce such prints even when the number of the prints is small.

In attempting to produce images having different glossiness using electrophotography, a method in which a color toner image is formed on a recording material using at least one color toner (such as yellow, magenta or cyan toner) and a transparent toner, wherein an image portion having the transparent toner image has glossiness different from the glossiness of the color image portion by ±20% or more due to difference of the melting points of the color toner and the transparent toner; a method in which after a fixed color toner image is formed, an image is formed using a transparent toner while decreasing the fixing temperature to prepare an image portion having high glossiness and another image portion having relatively low glossiness; and a method in which initially a fixed glossy image is formed and a non-glossy image is then formed and fixed, have been proposed. By using these methods, a copy having portions with different glossiness can be produced, but the glossiness of a glossy image portion of the copy is lower than the glossy portion of a pictorial print formed by the above-mentioned spot printing method.

Since a low temperature fixable toner has such a property as to be easily melted, the low temperature fixable toner is preferably used as a transparent toner because a glossy image can be formed with low fixing energy. However, when a low temperature fixable toner is prepared merely by decreasing the melting point of the toner, the toner tends to cause a preservation problem in that the toner has a poor preservability (for example, the toner is agglomerated when preserved at a high temperature). In addition, such toner tends to cause a hot offset problem in that a part of a toner image on a recording material adheres to the surface of a fixing member of a fixing device when the toner image is fixed at a relatively high temperature, and the transferred image is then transferred onto another portion of the recording material bearing the toner image or another recording material, thereby deteriorating the image qualities of the toner images.

For these reasons, the inventors recognized that there is a need for an image forming method which produces glossy images like photographic images at a low fixing temperature without causing the offset problem and the preservation problem.

BRIEF SUMMARY OF THE INVENTION

As an aspect of the present invention, an image forming method is provided which includes forming an electrostatic latent image on an image bearing member; developing the electrostatic latent image with at least one color developer including a color toner and a carrier, and another developer including a transparent toner and a carrier to form a color toner image and a transparent toner image on the image bearing member; transferring the color toner image and the transparent toner image to a recording material optionally via an intermediate transfer medium; and fixing the color toner image and the transparent toner image on the recording material. The color toner includes a polyester resin, and a colorant, and has a viscoelastic property such that the loss tangent (tan δ) of the color toner, which is defined as a ratio (G")/(G') of loss modulus (G") to storage modulus (G'), has a maximum peak at a temperature of from 80° C. to 160° C., and is not greater than 3 at the maximum peak. The transparent toner includes a crystalline polyester resin, and has a viscoelastic property such that the loss tangent (tan δ) of the transparent toner has a maximum peak at a temperature of from 80° C. to 160° C., and is not less than 3 at the maximum peak.

As another aspect of the present invention, an image forming apparatus is provided which includes an image bearing member to bear an electrostatic latent image thereon; a developing device to develop the electrostatic latent image with the color developer and the transparent toner-containing developer mentioned above to form a color toner image and a transparent toner image on the image bearing member; a transferring device to transfer the color toner image and the transparent toner image to a recording material optionally via an intermediate transfer medium; and a fixing device to fix the color toner image and the transparent toner image on the recording material.

As yet another aspect of the present invention, a process cartridge is provided which includes an image bearing member to bear an electrostatic latent image thereon; and a developing device to develop the electrostatic latent image with the color developer and the transparent toner-containing developer mentioned above to form a color toner image and a transparent toner image on the image bearing member. The image bearing member and the developing device are integrated into a single unit so as to be detachably attachable to an image forming apparatus.

The aforementioned and other aspects, features and advantages will become apparent upon consideration of the following description of the preferred embodiments taken in conjunction with the accompanying drawings.

DETAILED DESCRIPTION OF THE INVENTION

Figure 1:
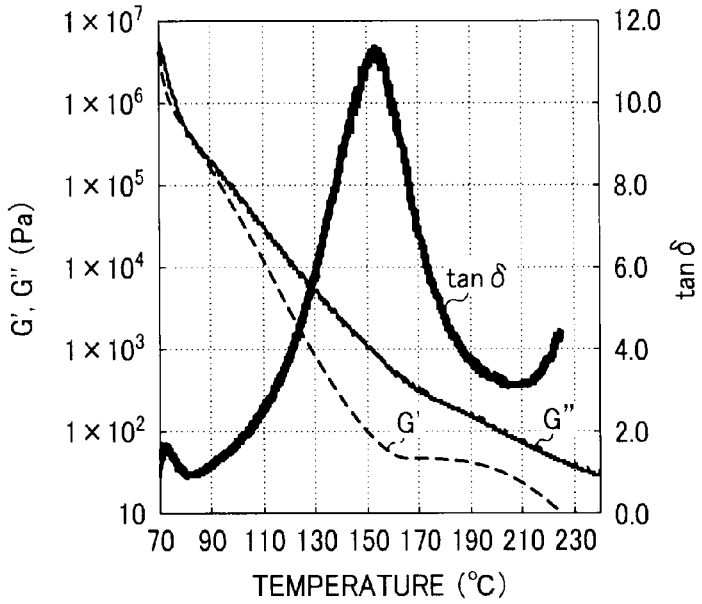
FIG. 1 is a graph illustrating curves of the loss modulus (G"), storage modulus (G') and loss tangent (tan δ) of a toner for use in the image forming method of the present invention.

The image forming method of the present invention includes forming an electrostatic latent image on an image bearing member; developing the electrostatic latent image with at least one color developer including a color toner and a carrier, and another developer including a transparent toner and a carrier to form a color toner image and a transparent toner image on the image bearing member; transferring the color toner image and the transparent toner image to a recording material optionally via an intermediate transfer medium; and fixing the color toner image and the transparent toner image on the recording material. The color toner includes a polyester resin and a colorant, and has a viscoelastic property such that the loss tangent (tan δ) of the color toner, which is defined as a ratio (G")/(G') of loss modulus (G") to storage modulus (G'), has a maximum peak at a temperature of from 80° C. to 160° C., and is not greater than 3 at the maximum peak. The transparent toner includes a crystalline polyester resin, and has a viscoelastic property such that the loss tangent (tan δ) of the transparent toner has a maximum peak at a temperature of from 80° C. to 160° C., and is not less than 3 at the maximum peak.

The image forming method, the image forming apparatus and the process cartridge of the present invention will be described in detail.

Initially, the transparent toner and the color toner for use in the present invention will be described.

When a toner having a good low temperature fixability is used, the fixing energy can be decreased. In addition, since the toner is sufficiently melted in the fixing process, high glossiness can be imparted to the resultant transparent toner image. The main purpose of using a transparent toner and the main function of the transparent toner are to impart high glossiness to a transparent toner image. However, when the low temperature fixability of a transparent toner is enhanced, the preservability of the toner tends to deteriorate. Therefore, it is a problem to be solved to develop a transparent toner having a good combination of low temperature fixability and preservability for a developing system using a color toner and a transparent toner.

In image forming apparatuses which use a transparent toner as well as color toners such as yellow (Y), magenta (M), cyan (C) and black (K) toners, it is typical that one of an additional developing unit using the transparent toner and other additional developing units using a color toner different from the Y, M, C and K toners is detachably attached optionally, as a fifth developing unit, to the developing section of the image forming apparatuses in which the Y, M, C and K developing units are always set. Therefore, if an additional developing unit using a color toner other than the Y, M, C and K toners is set as the fifth developing unit, the developing unit using the transparent toner is preserved. In this regard, the preservation conditions for such additional developing units may be severer than those for the Y, M, C and K developing units. Therefore, not only the transparent toner but also the color toners used for such additional developing units are required to have good preservability.

In the present invention, the transparent toner has a viscoelastic property such that the loss tangent (tan δ), which is defined as a ratio (G")/(G') of loss modulus (G") to storage modulus (G'), has a maximum peak at a temperature of from 80° C. to 160° C., and is not less than 3 at the maximum peak. The reason therefor will be described.

In order to impart a good combination of low temperature fixability and glossiness to a transparent toner, the transparent toner preferably has a property such that the storage modulus (G') of the toner sharply decreases from a relatively low temperature. If the transparent toner has a low storage modulus (G') at the fixing temperature, the melted transparent toner can easily enter recessed portions of a recording material having a low surface roughness and micro concaves of color toner images. In addition, plasticity becomes to have priority in the viscoelastic property of the toner, and therefore the fixed toner is hardly restored to the original form (i.e., particulate form). Therefore, the fixed toner image has good spreading property and smooth surface, and high glossiness can be imparted to the fixed toner image.

Meanwhile, in order to impart good hot offset resistance to a transparent toner, the transparent toner preferably has a viscoelastic property such that the decreasing rate of storage modulus (G') gradually lowers after the toner achieves a certain viscosity, i.e., the toner maintains a certain viscosity from a certain temperature. In addition, it is preferable that the loss modulus (G") of the transparent toner does not rapidly decrease unlike the storage modulus (G').

Thus, unless the storage modulus (G') of a transparent toner sharply decreases from a certain temperature while decreasing the decreasing rate in a certain temperature range, the transparent toner cannot have a peak in a tan δ curve as illustrated in FIG. 1.

When a transparent toner has such a loss modulus (G") and a storage modulus (G') as mentioned above, the transparent toner can have a peak in a tan δ curve as illustrated in FIG. 1. The maximum peak of the tan δ curve is preferably observed at a temperature of from 80° C. to 160° C.

When the maximum peak temperature is lower than 80° C., the storage modulus (G') of the transparent toner tends to seriously decrease at a relatively low temperature, and therefore the high temperature preservability of the toner deteriorates, i.e., the toner is agglomerated when preserved. In addition, the transparent toner tends to have too low viscoelasticity at a relatively high temperature, and the hot offset problem is often caused. In contrast, when the maximum peak temperature of the transparent toner is higher than 160° C., the toner has poor low temperature fixability.

When the maximum value of the loss tangent (tan δ) is too small, the storage modulus (G') does not relatively decrease compared to the loss modulus (G"), and a good combination of low temperature fixability, hot offset resistance and high glossiness cannot be imparted to the toner. In particular, in order to form a glossy image on the surface of a recording material using a transparent toner, it is important that the loss tangent (tan δ) of the transparent toner is not less than 3. The reason therefor is as follows.

Specifically, in order to enhance the glossiness of the surface of a fixed toner image is increased, it is necessary that the outermost surface of the toner image is as smooth as possible. In order to form a toner image having such a smooth surface, it is important that the storage modulus (G') is decreased to enhance the spreading property of the toner image (i.e., toner layer). In addition, it is also important that the toner layer has good affinity for the surface bearing the toner layer.

When a color toner image is formed, the color toner image (layer) is typically formed on a surface of a recording material such as paper. In this case, even when the storage modulus of the color toner is relatively high, the elasticity of the color toner image (layer) is absorbed by the recording paper due to good cushionability thereof, when the toner image is fixed by a typical fixing method applying heat and pressure to the toner image, or a part of the melted toner layer, which is a surplus when forming a smooth surface of the toner layer, is penetrated into cellulose fibers constituting the recording paper. Therefore, the fixed color toner image can have smooth surface.

However, when a transparent toner is used to impart high glossiness to a color toner image formed on a recording paper, the transparent toner layer is formed on the color toner image (layer), which is mainly constituted of a resin. Therefore, the elasticity of the transparent toner cannot be easily absorbed by the recording paper because the color toner image (layer) is present between the recording paper and the transparent toner image, or a part of the melted transparent toner layer, which is a surplus when forming a smooth surface of the toner layer, is hardly penetrated into cellulose fibers constituting the recording paper.

Thus, a transparent toner is under severer conditions than a color toner when forming a glossy image. Specifically, when the storage modulus (G') of the transparent toner used is relatively high, the surface of the transparent toner image, which has been fixed upon application of heat and pressure, is microscopically roughened due to return of the shape of the transparent toner to the original shape (i.e., particulate form) caused by the elasticity thereof, thereby deteriorating the smoothness and glossiness of the transparent toner image.

As a result of the present inventors' investigation, it is discovered that even when a transparent toner image (layer) is formed on a color toner image (layer), the transparent toner layer fixed in a fixing temperature range can have a smooth surface while maintaining good hot offset resistance if the peak of the loss tangent (tan δ) curve of the transparent toner, which is defined as a ratio (G"/G') of the loss modulus (G") to the storage modulus (G') of the toner, is not less than 3, thereby making it possible to form a glossy image. This is because the spreading property of the transparent toner has priority over the elasticity thereof.

The peak temperature and the maximum peak value of the loss tangent (tan δ) curve of a toner mainly depend on the viscoelasticity of the binder resin constituting the toner. However, by changing the load on a binder resin in the toner preparation process, for example, by changing the melt kneading conditions in the toner preparation process, it is possible to change the peak temperature and the maximum peak value of the loss tangent (tan δ) curve of the toner.

Further, when a crystalline polyester resin is used as a binder resin, the viscoelasticity of the toner can be changed by changing the softening point of a material used in combination with the crystalline polyester resin or the content of the crystalline polyester resin in the toner, thereby making it possible to change the peak temperature and the maximum peak value of the loss tangent (tan δ) curve of the toner.

In the present invention, a transparent toner image (layer) is formed not only on a color toner image (layer) but also on a surface of a recording material to form a special image thereon such as a watermark and a transparent image having a higher glossiness than the other portions of the recording material. In this regard, it is preferable that all of such special images can be prepared only by one transparent toner so that the number of image forming units can be reduced, thereby making it possible to miniaturize the image forming apparatus while reducing the costs of the image forming apparatus. In addition, such an image forming apparatus is preferable for users because the image forming apparatus can be used for various applications. Even when the transparent toner of the present invention is used for forming such special images, it is necessary that the maximum peak value of the loss tangent (tan δ) curve thereof is not less than 3 as long as the transparent toner is used for imparting a high glossiness to a color toner image as well. The maximum peak value of the loss tangent (tan δ) curve is preferably not less than 4.

The color toner for use in the present invention has a viscoelastic property such that the loss tangent (tan δ) has a maximum peak at a temperature of from 80° C. to 160° C., and the maximum peak value is not greater than 3, and preferably not greater than 2.5. The reason therefor is as follows.

As mentioned above, a transparent toner can produce glossy images when having a viscoelastic property such that the loss tangent (tan δ) has a maximum peak at a temperature of from 80° C. to 160° C., and the maximum peak value is not less than 3.

In contrast, a color toner for use in the present invention has a viscoelastic property such that the loss tangent (tan δ) has a maximum peak at a temperature of from 80° C. to 160° C., and the maximum peak value is not greater than 3. in this case, the difference between a transparent toner image and a color toner image can be increased, and therefore an image having a glossy spot like a photographic image can be produced. The maximum peak value of the loss tangent (tan δ) of a color toner is preferably not greater than 2.5.

In order to prepare a color toner having such a viscoelastic property as mentioned above, it is preferable to use a polyester resin as a binder resin while producing the toner using a polymerization method. The reason why such a viscoelastic property can be imparted to a color toner by using a polyester resin as a binder resin and a polymerization method as the toner preparation method is not yet determined.

The loss tangent (tan δ) of a transparent toner and a color toner is measured with a viscoelasticity measuring method. For example, the following method can be used.

(1) 0.8 grams of a sample (toner) is pelletized using a die having a diameter of 20 mm upon application of pressure of 30 MPa; and (2) the loss modulus (G"), the storage modulus (G') and the loss tangent (tan δ) of the sample are measured using an instrument, ADVANCED RHEOMETRIC EXPANSION SYSTEM from TA with a parallel cone having a diameter of 20 mm.

The measuring conditions are as follows.

Frequency: 1.0 Hz

Temperature rising speed: 2.0° C./min

Strain: 0.1% (automatic strain control, allowable minimum stress: 1.0 g/cm, allowable maximum stress: 500 g/cm, maximum applied strain: 200%, strain adjustment: 200%)

In this regard, the data of the loss tangent obtained when the storage modulus (G') becomes not greater than 10 are excluded.

It is preferable that each of the transparent toner and the color toner for use in the present invention has a weight average particle diameter of from 3 μm to 8 μm, and a particle diameter distribution such that the content of toner particles having a particle diameter of not greater than 4 μm is from 10% to 70% by number, the content of toner particles having a particle diameter of not less than 8 μm is from 1% to 20% by volume, and the content of toner particles having a particle diameter of not less than 10.08 μm is not greater than 6% by volume.

In the present application, the volume average particle diameter (Dv) and number average particle diameter (Dn) of a toner are determined by an instrument such as COULTER COUNTER TA-II and COULTER MULTISIZERS II, III and IV, which are manufactured by Beckman Coulter, Inc.

The measurement method is as follows.

(1) A surfactant serving as a dispersant, preferably 0.1 to 5 ml of a 1% aqueous solution of an alkylbenzenesulfonic acid salt, is added to 100 to 150 ml of an electrolyte such as 1% aqueous solution of first class NaCl or ISOTON-II manufactured by Beckman Coulter, Inc.;

(2) Two (2) to 20 mg of a sample (i.e., a toner) to be measured is added into the mixture;

(3) The mixture is subjected to an ultrasonic dispersion treatment for about 1 to 3 minutes; and (4) The volume-basis particle diameter distribution and number-basis particle diameter distribution of the toner are measured using the instrument mentioned above and an aperture of 100 μm.

The weight average particle diameter (Dw) and the volume average particle diameter (Dv) of the toner are determined from the thus obtained volume- and number-basis particle diameter distributions.

In this case, the particle diameter channels are following 13 channels:

2.00 μm≤C1<2.52 μm; 2.52 μm≤C2<3.17 μm;
3.17 μm≤C3<4.00 μm; 4.00 μm≤C4<5.04 μm;
5.04 μm≤C5<6.35 μm; 6.35 μm≤C6<8.00 μm;
8.00 μm≤C7<10.08 μm; 10.08 μm≤C8<12.70 μm;
12.70 μm≤C9<16.00 μm; 16.00 μm≤C10<20.20 μm;
20.20 μm≤C11<25.40 μm; 25.40 μm≤C12<32.00 μm; and
32.00 μm≤C13<40.30 μm.

Thus, particles having a particle diameter not less than 2.00 μm and less than 40.30 μm are targeted in this method.

In the present invention, a color toner and a transparent toner are used for the toner.

The color toner includes a polyester resin as a binder resin, and a colorant, and the transparent toner includes a crystalline polyester resin. In addition, each of the color toner and the transparent toner can optionally include other components such as other binder resins, release agents, charge controlling agents, external additives, and the like.

Next, the toner constituents will be described in detail.

(Crystalline Polyester Resin)

The transparent toner for use in the present invention includes a thermoplastic crystalline polyester resin.

When a crystalline polyester resin is used for the transparent toner, the resultant toner can be fixed at a relatively low fixing temperature, and a glossy transparent image can be formed even at a relatively low fixing temperature.

The content of a crystalline polyester resin in the transparent toner is preferably from 1% to 25% by weight, and more preferably from 1% to 15% by weight, based on the total weight of the binder resin components (such as amorphous polyester resins) included in the toner. When the content of a crystalline polyester resin is too high, a filming problem in that a film of the toner is formed on the surface of an image bearing member such as photoreceptors is easily caused and the preservability of the toner deteriorates. In addition, the transparency of the resultant toner deteriorates to an extent such that the toner cannot satisfy the requirement for the transparency of a transparent toner.

A crystalline polyester resin having a unit obtained from a polyalcohol and another unit obtained from a carboxylic acid is preferably used for the transparent toner. The crystalline polyester resin preferably includes a unit having the following formula (a) in an amount of 60% by mole based on the total of ester units included in the crystalline polyester resin.

$$—OCOC—R—COO—(CH_2)_n— \quad (a)$$

In formula (a), R represents a linear unsaturated aliphatic group having 2 to 20 carbon atoms, and n is an integer of from 2 to 20.

In formula (a), the group R is preferably a residual group of a linear unsaturated dicarbocylic acid having 2 to 20 carbon atoms, and more preferably a residual group of a linear unsaturated dicarbocylic acid having 2 to 4 carbon atoms. In addition, n is more preferably an integer of from 2 to 6.

Specific examples of the linear unsaturated dicarboxylic acids for use in forming the linear unsaturated aliphatic group include maleic acid, fumaric acid, 1,3-n-propenedicarboxylic acid, 1,4-n-butenedicarboxylic acid, and the like.

The group, —$(CH_2)_n$—, represents a residual group of a linear aliphatic dihydric alcohol. Specific examples of the linear aliphatic dihydric alcohol include ethylene glycol, 1,3-propylene glycol, 1,4-butanediol, 1,6-hexanediol, and the like.

By using a linear unsaturated aliphatic dicarboxylic acid as a carboxylic acid component, the resultant crystalline polyester resin can form a crystalline structure more easily than in a case of preparing a polyester resin by using an aromatic dicarboxylic acid as a carboxylic acid component.

Crystalline polyester resins can be prepared by subjecting (1) a polycarboxylic acid component including a linear unsaturated dicarboxylic acid or a derivative thereof (e.g., anhydrides, alkyl esters having 1 to 4 carbon atoms, and acid halides) and (2) a polyalcohol component including a linear aliphatic diol to a polycondensation reaction using a conventional method.

In this regard, the polycarboxylic acid component can include a small amount of polycarboxylic acids other than linear unsaturated dicarboxylic acids or their derivatives. Suitable materials for use as the polycarboxylic acids include (A) branched unsaturated aliphatic dicarboxylic acids, (B) saturated aliphatic polycarboxylic acids such as saturated aliphatic dicarboxylic acids and saturated aliphatic tricarboxylic acids; and (C) aromatic polycarboxylic acids such as aromatic dicarboxylic acids and aromatic tricarboxylic acids. The added amount of such polycarboxylic acids is not greater than 30% by mole, and preferably not greater than 10% by mole, based on the total of the carboxylic acid components so that the resultant polyester resin has crystallinity.

Specific examples of such polycarboxylic acids include dicarboxylic acids such as malonic acid, succinic acid, glutaric acid, adipic acid, suberic acid, sebacic acid, citraconic acid, phthalic acid, isophthalic acid, and terephthalic acid; tri- or more-carboxylic acids such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid; and the like.

The polyalcohol component can include a small amount of branched aliphatic dihydric alcohols, cyclic dihydric alcohols, and/or tri- or more-hydric alcohols. The added amount of such polyalcohols is not greater than 30% by mole, and preferably not greater than 10% by mole, based on the total of the polyalcohol components so that the resultant polyester resin has crystallinity.

Specific examples of such polyalcohols include 1,4-bis(hydroxymethyl)cyclohexane, polyethylene glycol, ethylene oxide adducts of bisphenol A, propylene oxide adducts of bisphenol A, glycerin, and the like.

Crystalline polyester resins for use in the transparent toner for use in the present invention preferably have relatively low molecular weight and sharp molecular weight distribution to impart good low temperature fixability to the toner. Specifically, the weight average molecular weight (Mw) of such crystalline polyester resins is preferably from 5,500 to 6,500, the number average molecular weight (Mn) thereof is preferably from 1,300 to 1,500 and the ratio (Mw/Mn) is preferably from 2 to 5, when the molecular weights Mw and Mn are determined by the molecular weight distribution obtained by subjecting o-dichlorobenzene-soluble components of the crystalline polyester resins to gel permeation chromatography (GPC).

The molecular weight distribution of a crystalline polyester resin is determined from a graph. Specifically, logarithmic molecular weights of components of the crystalline polyester resin are plotted on the horizontal axis, and weight percentages of the components are plotted on the vertical direction to prepare the molecular weight distribution curve of the crystalline polyester resin. In this case, it is preferable that the molecular weight peak is present in a weight percentage range of from 3.5% to 4.0% by weight, and the peak has a half width of not greater than 1.5.

The transparent toner preferably includes a lubricant. Since a transparent toner image takes the outermost position of overlaid plural toner images, the transparent toner image preferably has a good hot offset resistance, and therefore it is preferable to include a lubricant in the transparent toner so that the transparent toner image has good releasability from a fixing member. Specific examples of the lubricant include aliphatic hydrocarbon-based lubricants such as liquid paraffins, microcrystalline waxes, natural paraffins, synthesized paraffins, polyolefin waxes, and partially-oxidized versions, fluorides and chlorides of these materials; animal-derived lubricants such as beef tallow, and fish oils; plant-derived lubricants such as palm oils, soybean oils, canola oils, rice bran waxes and carnauba waxes; higher aliphatic alcohol/higher fatty acid based lubricants such as montan waxes; metal soap lubricants such as fatty amides, fatty bisamides, zinc stearate, calcium stearate, magnesium stearate, aluminum stearate, zinc oleate, zinc palmitate, magnesium palmitate, zinc myristate, zinc laurate, and zinc behenate; fatty acid esters, polyvinylidene fluoride, and the like, but are not limited thereto. These materials can be used alone or in combination.

When such a lubricant is included inside the transparent toner, the added amount thereof is from 0.1 to 15 parts by weight, and preferably from 1 to 7 parts by weight, per 100 parts by weight of the binder resin used for the transparent toner.

In this regard, a lubricant included inside the transparent toner means a lubricant included inside the mother toner (i.e., toner particles) of the transparent toner, and a lubricant used as an external additive is excluded therefrom. Therefore, specific examples of the lubricant included inside the transparent toner include a lubricant included inside toner particles while encapsulated (i.e., the lubricant is not present on the surface of the toner particles), and a lubricant dispersed in toner particles while a part thereof is present on the surface of the toner particles.

When a lubricant is included inside the transparent toner, good hot offset resistance can be imparted to the transparent toner while imparting a good combination of mechanical strength and abrasion resistance to fixed transparent toner images. Therefore, even when the transparent toner is used for high speed image forming apparatuses, a transparent toner image can be fixed at a relatively low fixing temperature. When the added amount of a lubricant is smaller than 0.1 parts by weight, the hot offset resistance cannot be satisfactorily enhanced. By contrast, when the added amount is larger than 10 parts by weight, a spent toner problem in that spent toner is adhered to the surface of particles of the carrier used in combination with the toner, thereby deteriorating the charging ability of the carrier tends to be caused, resulting in deterioration of image qualities.

When a lubricant is used as an external additive so as to be present on a surface of transparent toner particles, the weight ratio (L/R) of the lubricant (L) to the fixable resin (R) used for the transparent toner is from 0.001/100 to 1/100, and preferably from 0.01/100 to 0.3/100. When a lubricant is present on a surface of toner particles, the lubricant is directly contacted with the surface of an image bearing member, thereby forming a thin layer of the lubricant thereon, and therefore a toner image can be easily released from the surface of the image bearing member. In addition, adhesion of a toner image to the image bearing member can also be prevented by the thin layer of the lubricant.

When a fatty acid amide-based lubricant is included inside the transparent toner, not only the lubricating effect but also an effect such that the crystalline polyester resin is crystallized in the toner can be produced, thereby improving the preservability of the transparent toner. A fatty acid amide-based lubricant can be used alone or in combination with another lubricant to separately control impartment of releasability and acceleration of crystallization. For example, a combination of a lubricant which has good releasability imparting ability such as carnauba waxes and paraffin waxes, and a fatty acid amide-based lubricant which has good crystallization acceleration ability can be used. Specific examples of the fatty acid amide-based lubricant include stearamide, oleic amide, erucic amide, ethylene-bisstearamide, and the like. Among these fatty acid-amide based lubricants, N,N'-ethylene-bisstearamide is preferable.

In the present invention, it is preferable that a transparent toner image (layer) is formed, as an outermost layer, directly on a recording material or one or more color images so that the glossiness imparting effect thereof can be efficiently produced.

The method for forming a transparent toner image (layer) as an outermost layer is not particularly limited. For example, in an image forming apparatus having a developing device using a transparent toner and another developing device using a color toner, a method in which a color toner image, which is formed on an image bearing member, is transferred onto a recording material, and then a transparent toner image, which is formed on the image bearing member or another image bearing member, is transferred onto the recording material so that the transparent toner image is overlaid on the color toner image, can be used. When an intermediate transfer medium is used, a method in which after a transparent toner image is formed on the intermediate transfer medium, a color toner image is formed thereon to form a combined toner image on the intermediate transfer medium, and then the combined toner image is transferred onto a recording material can be used. Alternatively, a method in which after a color toner image is formed on an image bearing member, a transparent toner image is formed thereon to form a combined toner image on the image bearing member, and then the combined toner image is transferred onto an intermediate transfer medium, followed by transferring the combined toner image onto a recording material can be used.

Figure 2:
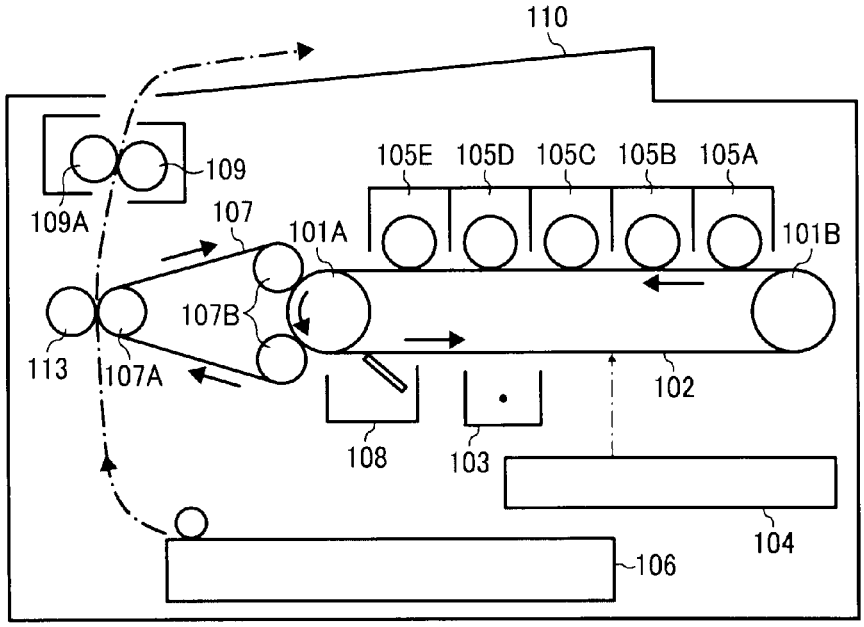
FIG. 2 is a schematic view illustrating an example of the image forming apparatus of the present invention.

An example of full color image forming apparatus which form full color images using yellow, magenta, cyan and black toners is illustrated in FIG. 2. As illustrated in FIG. 2, the image forming apparatus has five developing devices 105A-105E to form yellow, magenta, cyan, black and transparent toner images, respectively, on a photoreceptor belt 102. In this image forming apparatus, after color toner images are formed on the photoreceptor belt 102 by the developing devices 105A-105D, a transparent toner image is formed thereon by the developing device 105E to form a combined toner image on the photoreceptor belt 102. The combined toner image is then transferred onto an intermediate transfer medium 107, and the transferred toner image is then transferred onto a recording material so that the transparent toner image is formed on the color toner images as an outermost layer or directly on the recording material. The image forming apparatus will be described later in detail.

(Binder Resin)

Any known materials for use as binder resins of toner can be used for the transparent toner and the color toner for use in the present invention.

Specific examples thereof include styrene resins (i.e., homopolymers and copolymers of styrene and derivatives thereof) such as polystyrene, poly-α-methylstyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate copolymers, styrene-methacrylate copolymers, styrene-methyl α-chloroacrylate copolymers, and styrene-acrylonitrile-acrylate copolymers; and other resins such as epoxy resins, vinyl chloride resins, rosin modified maleic acid resins, phenolic resins, polyethylene resins, polypropylene resins, petroleum resins, polyurethane resins, ketone resins, ethylene-ethyl acrylate copolymers, xylene resins, polyvinyl butyral resins, and the like. The method for preparing these resins is not also particularly limited, and any known methods such as bulk polymerization methods, solution polymerization methods, emulsion polymerization methods, and suspension polymerization methods can be used.

The color toner for use in the present invention preferably includes a polyester resin. This is because polyester resins have an advantage over other resins such that a good combination of high temperature preservability and low temperature fixability can be imparted to toner.

Polyester resins for use as the binder resin of the color toner are prepared by subjecting an alcohol and a carboxylic acid to a condensation polymerization reaction.

Specific examples of such an alcohol include glycols such as ethylene glycol, diethylene glycol, triethylene glycol, and propylene glycol; 1,4-bis(hydroxymetha)cyclohexane; etherified bisphenols such as etherified bisphenol A; and other dihydric alcohols and polyhydric alcohols having three or more hydroxyl groups.

Specific examples of the carboxylic acid include dibasic organic acids such as maleic acid, fumaric acid, phthalic acid, isophthalic acid, terephthalic acid, succinic acid, and malonic acid; and polycarboxylic aids having three or more carboxyl groups such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxy-2-methyl-2-methylenecarboxypropane, and 1,2,7,8-octanetetracarboxylic acid.

The glass transition temperature of polyester resins used for the color toner for use in the present invention is preferably from 58° C. to 75° C.

The color toner for use in the present invention includes a colorant. Suitable materials for use as the colorant include known dyes and pigments.

Specific examples of the dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the color toner is preferably from 1% to 15% by weight, and more preferably from 3% to 10% by weight of the color toner.

Master batches, which are complexes of a colorant with a resin, can be used as the colorant of the color toner for use in the present invention. Specific examples of the resin used for preparing a master batch include such resins as mentioned above for use as the binder resin.

(Release Agent)

The transparent toner and the color toner for use in the present invention can include a release agent such as waxes. Specific examples of the release agents include natural waxes such as animal waxes (e.g., bees waxes, whale waxes and shellacs), vegetable waxes (e.g., carnauba waxes, Japan waxes, rice waxes, and candelilla waxes), petroleum waxes (e.g., paraffin waxes, and microcrystalline waxes), mineral waxes (e.g., montane waxes, and ozokerite); synthesized waxes such as Fischer-Tropsch waxes, polyethylene waxes, synthesized fatty waxes (e.g., ester waxes, ketone waxes, and amide waxes), and hydrogenated waxes; and the like.

The release agent included in the toner preferably has a thermal property such that an endothermic peak is observed at a temperature of from 80° C. to 110° C. when the release agent is subjected to differential scanning calorimetry (DSC) are preferable because the release agent in toner particles can exude from inside of the toner particles at a relatively low fixing temperature, thereby imparting good releasability to the toner. In this regard, the endothermic peak temperature is determined by the method defined in JIS K7122 (1987), and is defined as a melting point in this application.

Among the release agents mentioned above, synthesized hydrocarbon waxes, particularly petroleum waxes, are preferable. Synthesized hydrocarbon waxes are broadly classified into Fischer-Tropsch waxes, which can be prepared by reacting carbon monoxide with hydrogen, and polyethylene waxes, which can be prepared by polymerizing ethylene or thermally decomposing a polyethylene.

The waxes for use as release agents preferably have a polarity, such that the acid value thereof is from 3 to 8 mgKOH/g. It is possible to impart a polarity to a wax by treating or modifying the wax using a chemical method or a physical method. Modified waxes are broadly classified into oxidized waxes, which are prepared by oxidizing a wax using a chemical or air, and compounded waxes which are prepared by mixing a wax with a synthesized wax-compatible resin (such as ethylene-vinyl acetate copolymers, polyethylene, and synthesized rosin).

The release agent included in the toner for use in the present invention preferably has a penetration of not greater than 4 when the penetration is measured by the method described in JIS K-2235-5.4 in which a needle is penetrated into a sample with a load of 100 g at a predetermined temperature, to determine the length (mm) of the portion of the needle penetrated into the sample, and the length is multiplied by 10.

(Charge Controlling Agent)

The transparent toner and the color toner can include a charge controlling agent. Specific examples thereof include Nigrosine dyes and fatty acid metal salts, and their derivatives; onium salts such as phosphonium salts, and their lake pigments; triphenyl methane dyes, and lake pigments thereof; higher fatty acids, and metal salts thereof; diorganotin oxides such as dibutyltin oxide, dioctyltin oxide, and dicyclohexyltin oxide; diorganotin borates such as dibutyltin borate, dioctyltin borate, and dicyclohexyltin borate; organic metal complexes, chelate compounds, monoazo metal complexes, acetylacetone metal complexes, metal complexes of aromatic dicarboxylic acids, quaternary ammonium salts, aromatic hydroxylcarboxylic acids, and metal salts thereof, aromatic mono- or poly-carboxylic acids, and metal salts, anhydrides and esters thereof, phenol derivatives such as bisphenol, and the like. These materials can be used alone or in combination.

When a charge controlling agent is included inside the transparent toner and the color toner, the added amount is from 0.1 to 10 parts by weight per 100 parts by weight of the binder resin included in the toners. In this regard, colorless or white charge controlling agents are preferably used for the transparent toner.

(External Additives)

The transparent toner and the color toner can include an external additive. Specific examples of such an external additive include abrasives such as silica, powders of TEFLON (registered trademark), powders of polyvinylidene fluoride, powders of cerium oxide, powders of silicone carbide, and powders of strontium titanate; fluidity imparting agents such as powders of titanium oxide, and powders of aluminum oxide; agglomeration inhibitors; resin powders; electroconductive agents such as powders of zinc oxide, antimony oxide, and tin oxide; and developability improving agents such as white particulate materials and black particulate materials having charges with opposite polarities. These external additives can be used alone or in combination. By using such an external additive for a toner, the toner has good resistance to stresses caused in a developing device.

Next, the two component developers for use in the image forming apparatus will be described. The two component developers include at least one color developer including a color toner and a magnetic carrier, and another developer including a transparent toner and a magnetic carrier.

(Carrier)

Specific examples of the carrier for use in the two component developers include spinel-form ferrites such as magnetite and γ-iron oxide, spinel-form ferrites including one or more metal other than iron such as Mn, Ni, Mg and Cu, magnetoplumbite-form ferrites such as barium ferrite, and particulate metals (Fe or metal alloys) having an oxide layer on the surface thereof. The shape of the particulate carrier is not particularly limited, and for example, granular, spherical and needle-form carriers can be used. When a carrier having a relatively high magnetization intensity is needed, ferromagnetic particulate materials (such as iron) are preferably used. In view of chemical stability, spinel-form ferrites (such as magnetite and γ-iron oxide), and magnetoplumbite-form ferrites (such as barium ferrite) are preferably used.

Specific examples of the marketed carrier materials include MFL-35S, and MFL-35HL, which are from Powdertech Co., Ltd., DFC-400M, DFC-410M, and SM-350NV, which are from Dowa IP Creation Co., Ltd., etc.

By using a proper ferromagnetic particulate material for a resin carrier while controlling the added amount thereof, a resin carrier having a preferable magnetization intensity of from 30 to 150 emu/g (30 to 150 $A \cdot m^2/kg$) at 1000 Oe ($7.96 \times 10^4$ A/m) can be provided. Such resin carriers can be prepared, for example, by a method in which a particulate magnetic material and an insulating resin are heated so that the resin is melted, the mixture is then kneaded, and the kneaded mixture is sprayed using a spray drier, or a method in which a monomer or a prepolymer dispersed in an aqueous medium in the presence of a particulate magnetic material is reacted and crosslinked to form a condensation polymer (binder resin) in which the particulate magnetic material is dispersed.

It is possible to control the charging ability of a magnetic carrier by adhering a positively or negatively chargeable particulate material or electroconductive material on the surface of the magnetic carrier or by coating the surface of the magnetic carrier with a resin. Specific examples of the resin material used for the coating liquid include silicone resins, acrylic resins, epoxy resins, fluorine-containing resins, etc. The coating liquid can include a positively or negatively chargeable particulate material or electroconductive material. Among these resin materials, silicone resins and acrylic resins can be preferably used.

The content of the carrier in the developer is preferably from 85% to 98% by weight (i.e., the weight ratio (T/C) of the toner (T) to the carrier (C) is from 2/98 to 15/85). When the content is less than 85% by weight, the toner in the developer tends to scatter from the developing device, thereby forming defective images. In contrast, when the content is greater than 98% by weight, the toner tends to have an excessively high charge quantity, thereby forming low density images, and/or causing a problem in that the toner is insufficiently supplied to electrostatic images, thereby forming defective images.

The transparent toner for use in the present invention is preferably prepared by a pulverization method, which typically includes the following processes.

(1) toner components such as a binder resin (fixable resin), a lubricant, and optional components such as a colorant, a charge controlling agent, and a fixable resin, in which a charge controlling agent and/or an additive are dispersed, are mixed using a mixer such as HENSCHEL MIXER and SUPER MIXER;
(2) the mixture is heated so as to be melted, and the melted mixture is kneaded with a kneader such as heat rolls, kneaders and extruders so that the toner components are satisfactorily mixed; and
(3) after the kneaded mixture is cooled, the mixture is crushed and pulverized, followed by classification to prepare a toner.

In the pulverization process, a jet mill in which a crushed kneaded mixture is fed into high speed airflow so as to be collided against a collision plate to be pulverized, an interparticle collision method in which a crushed kneaded mixture is collided against each other to be pulverized, a mechanical pulverization method in which a crushed kneaded mixture is fed into a gap between a rotor rotated at a high speed and a stator to be pulverized, and the like method can be used.

The color toner for use in the present invention is preferably prepared by a polymerization method such as a solution suspension method, a polyester polymer chain growing method, a spray granulation method or the like method.

Hereinafter, a polyester polymer chain growing method will be described as one example of the color toner preparation method.

The polyester polymer chain growing method includes the following processes.

(1) toner components including an unmodified polyester resin, a polyester prepolymer (A), a compound (B) having amino group, a colorant, a release agent, and a charge controlling agent are dissolved or dispersed in an organic solvent to prepare a toner component liquid (hereinafter sometimes referred to as a first liquid);
(2) the toner component liquid is dispersed in an aqueous medium and the prepolymer (A) is reacted with the compound (B) in the mixture (this mixture is hereinafter sometimes referred to as a second liquid);
(3) the organic solvent is removed from the second liquid to prepare an aqueous dispersion of toner particles; and
(4) the dispersion is filtered and the obtained toner particles are washed and then dried to prepare toner particles (i.e., a mother toner).

The content of the prepolymer (A) in the toner components is generally from 10% to 55% by weight, preferably from 10% to 40%, and more preferably from 15% to 30% by weight, based on the total weight of the toner components.

In the process (1) mentioned above, all the toner components are not necessarily dissolved or dispersed in an organic solvent. For example, a method in which the toner component liquid is prepared without the compound (B), and the compound (B) is added to the second liquid. In this case, the reaction of the compound (B) with the prepolymer (A) is started from the interface therebetween, and therefore concentration gradient of the reaction product (i.e., urea-modified polyester) can be formed in the depth direction of the resultant toner particles. In addition, the colorant and/or the charge controlling agent may be mixed with the resultant toner particles without dispersed in the organic solvent. For example, a method in which after toner particles including no colorant are formed, a charge controlling agent is fixed to the toner particles and/or the toner particles are dyed with a dye by a known dyeing method can also be used.

When a ketimine compound, or an oxazoline compound is used instead of the compound (B), a compound having an amino group can be produced in the aqueous medium, and therefore the polymer chain growth reaction of the prepolymer (A) can be made in the second liquid.

When the prepolymer (A) and the compound (B) are reacted, a terminator can be used to control the crosslinking density and the molecular weight of the resultant urea-modified polyester. In this regard, a terminator is preferably added to the mixture of the toner component liquid including the compound (B) and the aqueous medium (i.e., the second liquid), so that the reaction of the prepolymer (A) with the compound (B) at the interface between the toner component liquid and the aqueous medium is suppressed, thereby forming concentration gradient of the reaction product (i.e., urea-modified polyester) in the depth direction of the toner particles.

Specific examples of the terminator include monoamines such as diethylamine, dibutylamine, butylamine and laurylamine; blocked monoamines such as ketimines and oxazolines; monohydric alcohols such as n-butyl alcohol, isobutyl alcohol, n-pentyl alcohol, isopentyl alcohol, n-hexyl alcohol, n-octyl alcohol, n-decyl acohol, cyclopentanol, cyclohexanol, benzyl alcohol, diphenyl alcohol, and triphenyl alcohol; and the like. Among these materials, n-butyl alcohol, isobutyl alcohol, n-pentyl alcohol, isopentyl alcohol, and n-hexyl alcohol are preferable because the materials are hardly dissolved in an aqueous medium, and the unreacted materials can be easily removed form the reaction product.

When the terminator is a monohydric alcohol, the alcohol is preferably added in an amount such that the equivalent ratio (H/I) of the hydroxyl group (H) of the alcohol to the isocyanate group (I) of the prepolymer (A) is generally 0.01 to 1, and preferably from 0.1 to 0.8.

Specific examples of the organic solvent for use in preparing the toner component liquid include toluene, xylene, benzene, carbon tetrachloride, methylene chloride, 1,2-dichloroethane, 1,1,2-trichloroethane, trichloroethylene, chloroform, monochlorobenzene, methyl acetate, ethyl acetate, methyl ethyl ketone, acetone, tetrahydrofuran, and the like, but are not limited thereto. These solvents can be used alone or in combination. Among these solvents, methyl acetate, and ethyl acetate are preferable.

The added amount of the organic solvent is generally from 40 parts to 300 parts by weight, preferably from 60 parts to 140 parts by weight, and more preferably from 80 parts to 120 parts by weight, based on 100 parts by weight of the toner components.

Suitable materials for use as the aqueous medium include water and mixtures of water and a water-soluble solvent. Specific examples of such a water-soluble solvent include alcohols such as methanol, isopropanol, and ethylene glycol; dimethylformamide; tetrahydrofuran; cellosolves such as methyl cellosolve; lower ketones such as acetone, and methyl ethyl ketone; and the like. These solvents can be used alone or in combination.

In order to reduce the viscosity of the aqueous dispersion of the toner component liquid (i.e., the viscosity of the second liquid), a solvent in which the prepolymer (A) can be dissolved can be added to the aqueous medium.

The added amount of the aqueous medium is generally from 50 parts to 2,000 parts by weight, and preferably from 100 parts to 1,000 parts by weight, based on 100 parts by weight of the toner components. When the added amount of the aqueous medium is less than 50 parts by weight, the toner component liquid can be satisfactorily dispersed in the aqueous medium. In contrast, adding an aqueous medium in an amount of greater than 2,000 parts by weight is not economical.

The aqueous medium can include a particulate resin to control the particle diameter of toner particles, to enhance the efficiency of the granulation process, and/or to modify the surface of the toner particles.

The particle diameter of such a particulate resin to be included in the aqueous medium is generally from 5 nm to 300 nm, and preferably from 20 nm to 200 nm.

The glass transition temperature of the particulate resin is generally from 40° C. to 90° C., and preferably from 50° C. to 70° C. When the glass transition temperature is lower than 40° C., the preservability of the resultant color toner often deteriorates. In contrast, when the glass transition temperature is higher than 90° C., the low temperature fixability of the color toner often deteriorates.

The weight average molecular weight of the particulate resin is generally from 4,000 to 200,000, and preferably from 4,000 to 50,000. When the weight average molecular weight is less than 4,000, the preservability of the resultant color toner often deteriorates. In contrast, when the weight average molecular weight is greater than 200,000, the low temperature fixability of the color toner often deteriorates.

Specific examples of the resins for use as the particulate resin include thermoplastic resins and thermosetting resins, which can be dispersed in the aqueous medium, such as vinyl resins (e.g., styrene-(meth)acrylate copolymers, styrene-butadiene copolymers, (meth)acrylic acid-acrylate copolymers, styrene-acrylonitrile copolymers, styrene-maleic anhydride copolymers, and styrene-(meth)acrylic acid copolymers; epoxy resins, unmodified polyester resins, resins having a urethane bond and/or a urea bond, melamine resins, aniline resins, ionomer resins, polycarbonate resins, and the like. These resins can be used alone or in combination. Among these resins, vinyl resins, polyurethane resins, epoxy resins, and unmodified polyester resins are preferable because an aqueous resin dispersion in which fine spherical resin particles are dispersed can be obtained by using the resins.

The content of such a particulate resin in the aqueous medium is generally from 0.5% to 10% by weight, and preferably from 1% to 3% by weight, based on the toner component liquid, so that toner particles can be easily granulated in the aqueous medium.

The toner particles prepared in the aqueous medium are preferably covered with the particulate resin with a coverage of from 1% to 90%, and more preferably from 5% to 80%. When the coverage is less than 1%, the resultant tone particles tend to be easily agglomerated. In contrast, when the coverage is greater than 90%, the release agent included inside the toner particles cannot easily exude from the toner particles.

The dispersing machines for use in dispersing the toner component liquid in the aqueous medium is not particularly limited, and known dispersing methods such as low speed shearing-type dispersing machines, high speed shearing-type dispersing machines, friction dispersing machines, high pressure jet air dispersing machines, and ultrasonic dispersing machines. Among these dispersing machines, high speed shearing-type dispersing machines are preferably used to prepare a dispersion in which particles having an average particle diameter of from 2 μm to 20 μm are dispersed.

When a high speed shearing-type dispersing machine is used, the revolution of the rotor of the dispersing machine is generally from 1,000 rpm to 30,000 rpm, and preferably from 5,000 rpm to 20,000 rpm. The dispersing time is not particularly limited, but when a batch dispersing machine is used, the dispersing time is generally from 0.1 minutes to 5 minutes. When the toner component liquid is dispersed in the aqueous medium, the temperature of the system is generally from 0° C. to 150° C. (under pressure), and preferably from 40° C. to 98° C.

In order to satisfactorily disperse the toner component liquid, a dispersant can be used for the aqueous medium. The dispersant is not particularly limited, and any known surfactants can be used.

Suitable materials for use as the surfactant include anionic surfactants such as alkylbenzene sulfonates, α-olefin sulfonates, and phosphates; cationic surfactants such as amine salt type surfactants (e.g., alkyl amine salts, amino alcohol fatty acid derivatives, polyamine fatty acid derivatives, and imidazoline), and quaternary ammonium salt type surfactants (e.g., alkyltrimethyl ammonium salts, dialkyldimethyl ammonium salts, alkyldimethylbenzyl ammonium salts, pyridinium salts, alkylisoquinolinium salts, and benzethonium chloride); nonionic surfactants (e.g., fatty acid amide derivatives, and polyhydric alcohol derivatives); and ampholytic surfactants (e.g., alanine, dodecylbis(aminoethyl)glycin, bis(octylaminoethyle)glycin and N-alkyl-N,N-dimethylammonium betaine).

Among such surfactants, surfactants having a fluoroalkyl group are preferable.

Specific examples of anionic surfactants having a fluoroalkyl group include fluoroalkyl carboxylic acids having from 2 to 10 carbon atoms and metal salts thereof, disodium perfluorooctanesulfonylglutamate, sodium 3-{ω-fluoroalkyl (C6-C11)oxy}-1-alkyl(C3-C4)sulfonate, sodium 3-{ω-fluoroalkanoyl(C6-C8)-N-ethylamino}-1-propanesulfonate, fluoroalkyl(C11-C20) carboxylic acids and their metal salts, perfluoroalkylcarboxylic acids (C7-C13) and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyl trimethyl ammonium salts, salts of perfluoroalkyl(C6-C10)-N-ethylsulfonyl glycin, monoperfluoroalkyl(C6-C16)ethylphosphates, and the like.

Specific examples of the marketed products of such anionic surfactants having a fluoroalkyl group include SARFRON S-111, S-112 and S-113, which are manufactured by Asahi Glass Co., Ltd.; FLUORAD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 123B, 306A, 501, 201 and 204, which are manufactured by Tohchem Products Co., Ltd.; FUTARGENT F-100 and F150 manufactured by Neos; etc.

Specific examples of the cationic surfactants having a fluoroalkyl group include primary, and secondary amines, and secondary amino acids, which have a fluoroalkyl group; quaternary aliphatic ammonium salts having a fluoroalkyl group such as perfluoroalkyl(C6-C10)sulfoneamidepropyltrimethylammonium salts, benzalkonium salts, benzethonium chloride, pyridinium salts, and imidazolinium salts; and the like.

Specific examples of the marketed products of cationic surfactants having a fluoroalkyl group include SARFRON S-121 (from Asahi Glass Co., Ltd.); FLUORAD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

The aqueous medium can include an inorganic dispersant, which is hardly soluble in water. Specific examples of such inorganic dispersants include tricalcium phosphate, calcium carbonate, titanium oxide, colloidal silica, and hydroxyapatite.

When an inorganic dispersant such as calcium phosphate, which can be dissolved in an acid or alkali, is used, it is preferable to remove calcium phosphate from the resultant toner particles using a method including dissolving residual calcium phosphate using an acid or an alkali, and then washing the resultant toner particles with water, or a method in which calcium phosphate is decomposed using an enzyme.

The aqueous medium can include a protection colloid to stably disperse the toner component liquid in the aqueous medium.

Specific examples of such protection colloids include homopolymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and methylol compounds thereof, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymer protection colloid.

In order to remove the organic solvent from the second liquid, a method in which the second liquid is gradually heated under normal or reduced pressure to perfectly evaporate the organic solvent included therein can be used. Alternatively, a method in which the second liquid is sprayed in a dry environment to dry the organic solvent and water included therein, resulting in formation of toner particles, can be used.

The dry environment mentioned above can be formed by heating gases of air, nitrogen, carbon dioxide, combustion gas, etc., preferably, to a temperature not lower than the boiling point of the solvent having the highest boiling point among the solvents used for the second liquid. Toner particles having desired properties can be rapidly prepared by performing this treatment using a spray dryer, a belt dryer, a rotary kiln, and the like.

Next, one or more external additives such as fluidizers and cleanability improving agents are added to the resultant toner particles, and the mixture is agitated by a mixer, so that the external additives cover the surface of the toner particles while being dissociated. Thus, the color toner for use in the present invention can be prepared.

Next, the image forming method and apparatus, and the process cartridge of the present invention will be described.

The image forming method of the present invention includes forming an electrostatic latent image on an image bearing member; developing the electrostatic latent image with a first developer including the color toner mentioned above and a carrier, and a second developer including the transparent toner mentioned above and a carrier to form a color toner image and a transparent toner image on the image bearing member; transferring the color toner image and the transparent toner image to a recording material optionally via an intermediate transfer medium; and fixing the color toner image and the transparent toner image on the recording material.

The image forming apparatus of the present invention includes an image bearing member to bear an electrostatic latent image thereon; an electrostatic latent image forming device to form the electrostatic latent image on the image bearing member; a developing device to develop the electrostatic latent image with the above-mentioned first and second developers to form a color toner image and a transparent toner image on the image bearing member; a transferring device to transfer the color toner image and the transparent toner image to a recording material optionally via an intermediate transfer medium; and a fixing device to fix the color toner image and the transparent toner image on the recording material.

The process cartridge of the present invention includes an image bearing member to bear an electrostatic latent image thereon; and a developing device to develop the electrostatic latent image with the above-mentioned first and second developers to form a color toner image and a transparent toner image on the image bearing member. The image bearing member and the developing device are integrated into a single unit so as to be detachably attachable to an image forming apparatus.

Specifically, in the image forming method and apparatus of the present invention, an image bearing member such as photoreceptor belts and photoreceptor drums is evenly charged (charging process), and then the charged image bearing member is irradiated with light to form an electrostatic latent image thereon (electrostatic latent image forming process). The electrostatic latent image is developed with a first developer including a color toner (i.e., the color toner mentioned above) and a carrier, and a second developer including a transparent toner (i.e., the transparent toner mentioned above) and a carrier to form a color toner image and a transparent toner image on the image bearing member (developing process). The toner images are transferred onto a recording material directly or via an intermediate transfer medium (transferring process). The toner images are fixed to the recording material upon application of heat and pressure (fixing process) to form an image on the recording material. In addition, a cleaning process in which the surface of the image bearing member is cleaned with a cleaning member such as blades and rollers after the toner images are transferred, a discharging process in which residual charges remaining on the surface of the image bearing member are discharged before the charging process, and other known processes can also be performed optionally.

The image forming method and apparatus, and the process cartridge of the present invention will be described in detail by reference to drawings.

FIG. 2 illustrates an electrophotographic image forming apparatus, which is an example of an image forming apparatus of the present invention.

Referring to FIG. 2, the image forming apparatus includes a photoreceptor belt 102, which serves as an image bearing member and is rotated by a driving roller 101A and a driven roller 101B while tightly stretched thereby. In addition, the image forming apparatus includes a charger 103 to charge the surface of the photoreceptor belt 102, an image writing unit 104 serving as an electrostatic latent image forming device to irradiate the charged photoreceptor belt 102 with a laser beam to form an electrostatic latent image on the photoreceptor belt 102, developing units 105A-105D which serve as a developing device and contain yellow, magenta, cyan and black toners, each of which is the color toner mentioned above, to develop electrostatic latent images with the toners to prepare color toner images on the surface of the photoreceptor belt 102, and another developing unit 105E which also serves as a developing device and contains a transparent toner, which is the transparent toner mentioned above, to form a transparent toner image on the photoreceptor belt 102. The image forming apparatus further includes a recording material sheet cassette 106 to contain and feed sheets of a recording material such as paper sheets, an intermediate transfer belt 107, to which the toner images formed on the photoreceptor belt 102 are transferred and which are rotated by a driving roller 107A, and driven rollers 107B and 107B to transfer the toner images to the recording material using a secondary transfer roller 113, a cleaner 108 to clean the surface of the photoreceptor belt 102 after the toner images thereon are transferred, a fixing device including a fixing roller 109 and a pressure roller 109A to fix the toner image on the receiving material, and a copy tray 110 on which a copy (i.e., a recording material sheet bearing a fixed toner image thereon) is stacked.

This color image forming apparatus uses the intermediate transfer belt 107, which is a flexible belt and which is rotated clockwise by the driving roller 107A and a pair of driven rollers 107B while tightly stretched thereby. A portion of the intermediate transfer belt 107 located between the pair of driven rollers 107B and 107B is contacted with the outer surface of a portion of the photoreceptor belt 102 contacted with the driving roller 101A.

When a full color image and a transparent image are formed in the color image forming apparatus, yellow, magenta, cyan and black toner images and a transparent toner image formed on the photoreceptor belt 102 by the developing units 105A-105D are sequentially transferred onto the intermediate transfer belt 107 so as to be overlaid, thereby forming a combined color toner image on the intermediate transfer belt 107. The combined color toner image is transferred onto a recording material sheet, which is fed from the recording material sheet cassette 106, by the secondary transfer roller 113. In this case, the transparent toner image is present as an outermost layer. The recording material sheet bearing the combined color toner image thereon is fed to a fixing nip between the fixing roller 109 and the pressure roller 109A so that the toner image is fixed thereon by the rollers 109 and 109A. The recording material sheet bearing the fixed toner image thereon (i.e., copy) is discharged so as to be stacked on the copy tray 110.

After the developing units 105A-105E perform the developing operations using the respective developers contained therein, the concentrations of toners contained in the developers decrease. In this regard, the concentration of the toner in a developer is detected by a toner concentration sensor. When decrease of the toner concentration is detected by a toner concentration sensor, a developer supplying device connected with the developing unit 105 is operated to supply the toner to the developing device 105, thereby increasing the toner concentration of the developer. In this regard, when the developing unit uses a trickle developing method, i.e., when the developing unit is equipped with a developer discharging mechanism to discharge part of the developer from the developing unit, a mixture of the toner and the carrier is supplied to the developing unit instead of the toner by itself.

In the image forming apparatus illustrated in FIG. 2, color toner images formed on the photoreceptor 102 are overlaid on the intermediate transfer belt 107. However, the image forming apparatus of the present invention is not limited thereto. For example, a direct-transfer type image forming apparatus in which color toner images and a transparent toner image formed on one or more photoreceptors are directly transferred onto a recording material can also be used as the image forming apparatus of the present invention.

Figure 3:
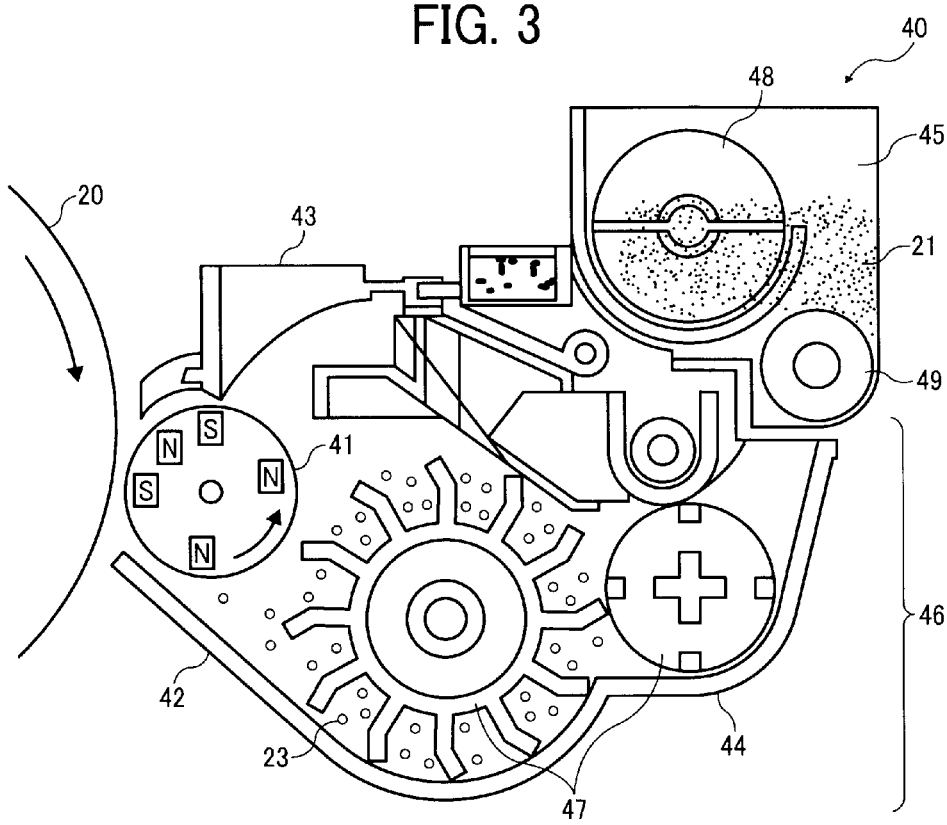
FIG. 3 is a schematic view illustrating a developing device for use in the image forming apparatus of the present invention.

FIG. 3 is a schematic view a developing device for use as the developing unit of the image forming apparatus of the present invention. The developing device is not limited thereto, and modifications such as the below-mentioned modifications can be made thereto.

Referring to FIG. 3, a developing device 40 is arranged so as to be opposed to an image bearing member 20 (photoreceptor drum). The developing device 40 includes, as main components, a developing sleeve 41, a developer containing portion 46 including a developer container 42 and a support case 44, and a doctor blade 43 serving as a regulating member.

A toner hopper 45 serving as a toner container is connected with the support case 44, which has an opening on the photoreceptor side thereof. The developer containing portion 46, which is located in the vicinity of the toner hopper 45, contains the developer of the present invention including a toner 21, which is the color toner or the transparent toner mentioned above, and a carrier 23, and has developer agitators 47 to agitate the developer to impart frictional/releasing charges to particles of the toner 21.

In the toner hopper 45, a toner agitator 48 and a toner supplying member 49, which are rotated by a driving device, are provided. The toner agitator 48 and the toner supplying member 49 supply the toner 21 in the toner hopper 45 to the developer containing portion 46 while agitating the toner.

The developer sleeve 41, which is arranged so as to be opposed to the image bearing member 20, is rotated by a driving device (not shown) in a direction indicated by an arrow. The developing sleeve 41 has magnets therein to form magnetic brush (i.e., chains of carrier particles (developer)) thereon. The magnets serve as a magnetic field forming member, and are fixed (i.e., do not move).

The doctor blade 43 serving as a regulating member is integrally provided on one side of the developer container 42. In this example, the doctor blade 43 is arranged such that a predetermined gap is formed between the tip of the doctor blade and the circumferential surface of the developing sleeve 41.

When this developing device is used, the developing method is performed as follows. Specifically, the toner 21 is fed from the toner hopper 45 to the developer containing portion 46 by the toner agitator 48 and toner supplying member 49, and the toner 21 and carrier 23 (i.e., the developer) are agitated by the developer agitators 47, resulting in impartment of frictional/releasing charge to the toner. The developer is born on the surface of the developing sleeve 41, and then fed to the development region, in which the developing sleeve is opposed to the image bearing member 20. In the developing region, only the toner 21 is adhered to an electrostatic latent image formed on the image bearing member 20, resulting in formation of a toner image on the surface of the image bearing member 20.

Figure 4:
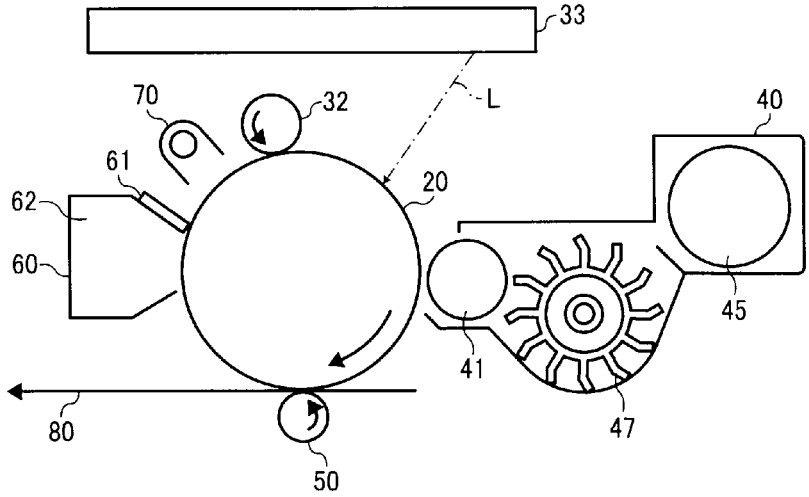
FIG. 4 is a schematic view illustrating an image forming section for use in the image forming apparatus of the present invention.

FIG. 4 is a cross-sectional view of an example of the image forming apparatus of the present invention, which includes the developing device mentioned above by reference to FIG. 3. The image forming apparatus includes a charging device 32 to charge a photoreceptor drum serving as the image bearing member 20; an irradiating device 33 to irradiate the charged photoreceptor with light L to form an electrostatic latent image on the photoreceptor drum 20; the developing device 40 to develop the electrostatic latent image with one of the developers mentioned above (such as the color developers and the transparent toner) to form a toner image (a color or transparent toner image) on the photoreceptor drum; a transfer device 50 configured to transfer the toner image onto a recording material 80; a cleaning device 60 including a cleaning blade 61 and a collected toner container 62 to clean the surface of the photoreceptor drum; and a discharging lamp 70 to reduce the residual charges present on the photoreceptor drum. These devices are arranged around the photoreceptor drum 20. In this image forming apparatus, the charging device 32 and the irradiating device 33 serve as an electrostatic latent image forming device.

In this image forming apparatus, the charging device 32 is a short-range charger, and the gap between the surface of the photoreceptor drum 20 and the surface of the charging roller of the charging device 32 is about 0.2 mm. In this regard, it is preferable to apply a DC voltage superimposed with an AC voltage to the charging device 32 so that the photoreceptor drum 20 can be evenly charged by the charging device.

An example of the image forming method of the present invention is as follows.

This example of the image forming method performs a nega-posi image forming operation. Specifically, after charges remaining on the photoreceptor drum 20, which serves as the image bearing member and which is typified by an organic photoreceptor (OPC) having an organic photosensitive layer, are discharged by the discharging lamp 70 (i.e., discharging process), the surface of the photoreceptor drum 20 is negatively charged by the charging device 32 such as charging rollers and charging wires (i.e., charging process). Next, laser light emitted by the irradiating device 33 irradiates the charged photoreceptor drum 20 to form an electrostatic latent image thereon (i.e., electrostatic latent image forming process or irradiating process). In this regard, the absolute value of the potential of an irradiated portion of the photoreceptor drum 20 is lower than that of a non-irradiated portion thereof.

Laser light emitted by a laser diode of the irradiating device 33 is reflected by a polygon mirror, which is rotated at a high speed, to scan the surface of the photoreceptor drum 20 in a direction (i.e., main scanning direction) parallel to the rotation axis of the photoreceptor drum, resulting in formation of an electrostatic latent image on the photoreceptor drum. The thus formed electrostatic latent image is developed with the developer on the developing sleeve 41, resulting in formation of a toner image (a color or transparent toner image) on the photoreceptor drum 20. In this developing process, a proper DC voltage, which is optionally superimposed with an AC voltage and whose voltage is between the potential of the irradiated portion of the photoreceptor drum 20 and the potential of the non-irradiated portion thereof, is applied as a development bias to the developing sleeve 41 by a voltage applicator.

Meanwhile, the recording material 80 such as paper sheets is fed by a feeding device (such as the recording material sheet cassette 106 mentioned above). The thus fed recording material 80 is timely fed by a pair of registration rollers to a transfer nip formed between the photoreceptor drum 20 and the transfer device 50 so that the toner image on the photoreceptor drum 20 is transferred onto a proper position of the recording material 80 in the transfer region. In this regard, it is preferable that a voltage having a polarity opposite to that of the charge of the toner 21 is applied as a transfer bias to the transfer device 50. The recording material 80 bearing the toner image thereon is then separated from the photoreceptor drum 20. Thus, a toner image is formed on the recording material 80.

Residual toner particles remaining on the photoreceptor drum 20 even after the transfer process are removed therefrom by the cleaning blade 61 of the cleaning device 60 (i.e., cleaning process).

The thus collected toner particles are stored in the collected toner container 62. The collected toner particles may be fed by a toner recycling device to the developing device or the toner hopper 45 to be reused.

The recording material 80 bearing the toner image thereon is then fed to a fixing device (such as heat fixing devices) to fix the toner image on the recording material. In this regard, as mentioned above by reference to FIG. 1, the image forming apparatus illustrated in FIG. 4 can have multiple developing devices so that multiple color toner images and a transparent toner image are sequentially formed on the photoreceptor drum 20, and the toner images are sequentially transferred onto the recording material 80 optionally via an intermediate transfer medium to form a combined toner image on the recording material 80. The combined toner image is then fixed by a fixing device.

Figure 5:
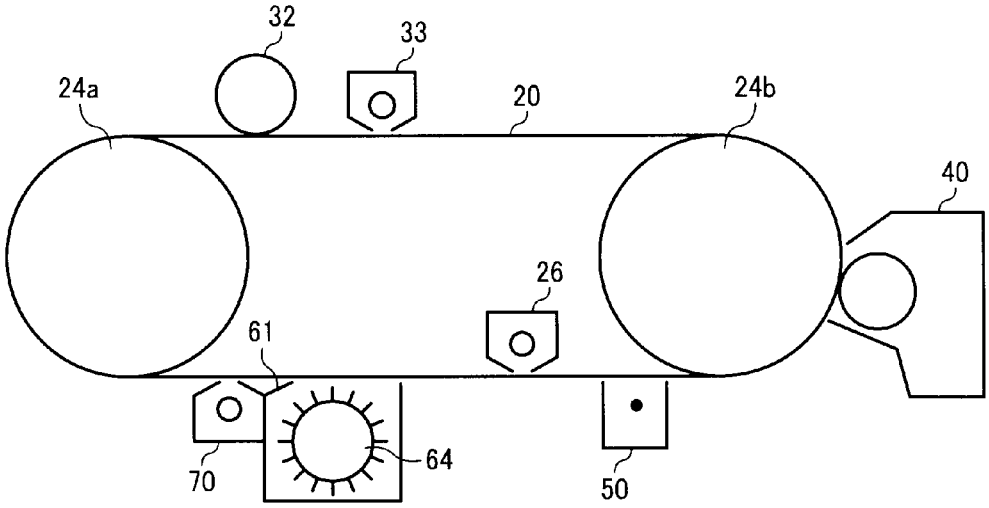
FIG. 5 is a schematic view illustrating another image forming section for use in the image forming apparatus of the present invention.

FIG. 5 illustrates another example of the image forming apparatus of the present invention. The image bearing member 20 is an endless-belt form photoreceptor having configuration such that at least a photosensitive layer is formed on an electroconductive substrate. The photoreceptor belt 20 is driven so as to be rotated by driving rollers 24*a* and 24*b*. Similarly to the image forming apparatus illustrated in FIG. 4, the photoreceptor belt 20 is charged by the charging device 32, and then exposed to imagewise light emitted by the irradiating device 33, resulting in formation of an electrostatic latent image on the photoreceptor belt 20. The electrostatic latent image is developed by the developing device 40 to form a toner image (i.e., a color or transparent toner image) on the photoreceptor belt 20, and the toner image is transferred onto a recording material by a charger 50 serving as the transfer device. The photoreceptor belt 20 is then subjected to a pre-cleaning irradiating process using a light source 26; a cleaning process using a cleaning device including the cleaning blade 61 and a cleaning brush 64; and a discharging process using the discharging lamp 70. In the image forming apparatus illustrated in FIG. 5, the pre-cleaning irradiation process is performed from the backside (i.e., substrate side) of the photoreceptor belt 20. In this regard, the substrate of the photoreceptor belt 20 is transparent so that light used for the pre-cleaning light irradiation process reaches the photosensitive layer of the photoreceptor belt 20.

Figure 6:
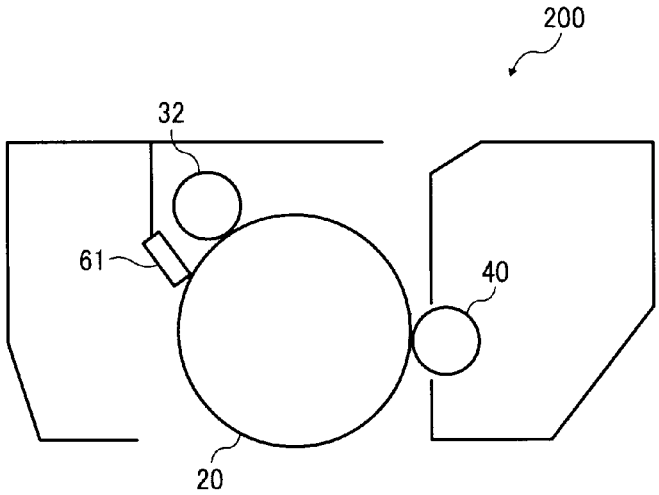
FIG. 6 is a schematic view illustrating an example of the process cartridge of the present invention.

FIG. 6 illustrates an example of the process cartridge of the present invention. The process cartridge uses the developer (a developer including a color or transparent toner) mentioned above. Referring to FIG. 6, the process cartridge 200 includes the image bearing member (photoreceptor drum) 20, a charger (such as brush-form contact-type chargers) serving as the charging device 32, the developing device 40 containing the developer, and the cleaning blade 61 serving as the cleaning device. These devices are integrated so that the process cartridge is detachably attachable to a main body of an image forming apparatus such as copiers and printers.

The process cartridge of the present invention is not limited to the process cartridge illustrated in FIG. 6. The process cartridge of the present invention includes at least an image bearing member to bear an electrostatic latent image thereon, and a developing device to develop the electrostatic latent image with a developer including the color toner mentioned above and another developer including the transparent toner mentioned above, which are integrated so that the process cartridge is detachably attachable to a main body of an image forming apparatus. The process cartridge can optionally include other devices such as charging devices, cleaning devices and discharging devices.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

1. Preparation of Binder Resins (Polyester Resins A-F)

1-1. Preparation of Polyester Resin A

The following components were fed into a 5-liter autoclave equipped with a distillation column so that the total weight of the components was 4,000 g.

Alcoholic Components

| | |
|---|---|
| Polyoxypropylene(2.2)-2,2-bis(4-hydroxyphenyl)propane (BPA-PO) | 55% by mole |
| Ethylene glycol | 40% by mole |
| Glycerin | 5% by mole |

Carboxylic Acid Components

| | |
|---|---|
| Adipic acid | 5% by mole |
| Terephthalic acid | 55% by mole |
| Isophthalic acid | 40% by mole |

In this regard, the molar ratio of the alcoholic components to the carboxylic acid components was 1/1.

The mixture was subjected to an esterification reaction at a temperature of from 170° C. to 260° C. under normal pressure without using a catalyst. Next, antimony trioxide in an amount of 400 ppm based on the total weight of the carboxylic acid components was added to the reaction product. The mixture was subjected to a polycondensation reaction at 250° C. under a reduced pressure of 3 torr (i.e., mmHg) while removing the glycols from the reaction system, resulting in preparation of a polyester resin A. The reaction was continued until the reaction product had an agitation torque of 10 kg·cm (when measured at a revolution of 100 rpm). The reaction was stopped by releasing the autoclave from the decompression state.

1-2 Preparation of Polyester Resin B

The procedure for preparation of the polyester resin A was repeated except that the alcoholic components and the carboxylic acid components were changed as follows.

Alcoholic Components

| | |
|---|---|
| Polyoxyethylene(2.2)-2,2-bis(4-hydroxyphenyl)propane (BPA-EO) | 55% by mole |
| Ethylene glycol | 40% by mole |
| Glycerin | 5% by mole |

Carboxylic Acid Components

| | |
|---|---|
| Adipic acid | 5% by mole |
| Terephthalic acid | 55% by mole |
| Isophthalic acid | 40% by mole |

Thus, a polyester resin B was prepared.

1-3 Preparation of Polyester Resin C

The procedure for preparation of the polyester resin A was repeated except that the alcoholic components and the carboxylic acid components were changed as follows.

Alcoholic Components

| | |
|---|---|
| Polyoxyethylene(2.2)-2,2-bis(4-hydroxyphenyl)propane (BPA-EO) | 35% by mole |
| Ethylene glycol | 55% by mole |
| Glycerin | 10% by mole |

Carboxylic Acid Components

| | |
|---|---|
| Adipic acid | 30% by mole |
| Terephthalic acid | 40% by mole |
| Isophthalic acid | 30% by mole |

Thus, a polyester resin C was prepared.

1-4 Preparation of Polyester Resin D

The procedure for preparation of the polyester resin A was repeated except that the alcoholic components and the carboxylic acid components were changed as follows.

Alcoholic Components

| | |
|---|---|
| Polyoxypropylene(2.2)-2,2-bis(4-hydroxyphenyl)propane (BPA-PO) | 57% by mole |
| Ethylene glycol | 38% by mole |
| Glycerin | 5% by mole |

Carboxylic Acid Components

| | |
|---|---|
| Terephthalic acid | 55% by mole |
| Isophthalic acid | 40% by mole |
| Trimellitic acid | 5% by mole |

Thus, a polyester resin D was prepared.

1-5 Preparation of Polyester Resin E

The procedure for preparation of the polyester resin A was repeated except that the alcoholic components and the carboxylic acid components were changed as follows.

Alcoholic Components

| | |
|---|---|
| Polyoxypropylene(2.2)-2,2-bis(4-hydroxyphenyl)propane (BPA-PO) | 70% by mole |
| Ethylene glycol | 30% by mole |

Carboxylic Acid Components

| | |
|---|---|
| Terephthalic acid | 45% by mole |
| Isophthalic acid | 40% by mole |
| Trimellitic acid | 15% by mole |

Thus, a polyester resin E was prepared.

1-6 Preparation of Polyester Resin F

The procedure for preparation of the polyester resin A was repeated except that the alcoholic components and the carboxylic acid components were changed as follows.

Alcoholic Components

| | |
|---|---|
| Polyoxyethylene(2.2)-2,2-bis(4-hydroxyphenyl)propane (BPA-EO) | 30% by mole |
| Ethylene glycol | 50% by mole |
| Glycerin | 20% by mole |

Carboxylic Acid Components

| | |
|---|---|
| Adipic acid | 35% by mole |
| Terephthalic acid | 35% by mole |
| Isophthalic acid | 30% by mole |

Thus, a polyester resin F was prepared.

The thus prepared polyester resins A-E were evaluated with respect to the following properties.

(1) Softening Point

A flow tester, CFT-500D from Shimadzu Corp., was used to measure the softening point. Specifically, one (1) gram of a resin was heated at a temperature rising speed of 6° C./min while applying a pressure of 1.96 MPa to the resin with a plunger so that the melted resin be extruded from a nozzle having a length of 1 mm and a diameter of 1 mm. A graph showing the relation between the temperature and the amount of decent of the plunger was prepared, and the softening point of the resin was determined as the temperature, at which the amount of decent of the plunger is ½ (i.e., half the resin (0.5 g of the resin) has been flown out of the nozzle).

(2) Glass Transition Temperature (Tg)

A differential scanning calorimeter (DSC), DSC210 from Seiko instruments Inc., was used to measure the glass transition temperature. Specifically, 0.01 to 0.02 g of a resin was set on an aluminum pan, and the resin was heated to 200° C. in the differential scanning calorimeter. After the resin was cooled to 0° C. at a temperature falling speed of 10° C./m, the resin was heated again to 200° C. at a temperature rising speed of 10° C./m while recording a DSC curve. The glass transition temperature (Tg) was determined as the temperature, at which an extension of the base line of the DSC curve in a temperature range lower than the maximum endothermic peak crosses the rising portion of the maximum endothermic peak (i.e., a tangent to a curve of from a rise start point of the maximum endothermic peak to the top of the peak).

(3) Acid Value (AV)

The acid value of a resin was measured by the method of JIS K0070 except that the solvent (i.e., a mixture solvent of ethanol and ether) was replaced with a mixture solvent of acetone and toluene in a volume ratio of 1/1.

(4) Loss Tangent Peak Temperature (Tan δ Peak Temp.)

The loss tangent (tan δ) of a resin was measured with an instrument, ADVANCED RHEOMETRIC EXPANSION SYSTEM from TA. Specifically, the method is as follows.

1) 0.8 grams of a resin is pelletized using a die having a diameter of 20 mm upon application of pressure of 30 MPa thereto; and
2) the loss modulus (G"), the storage modulus (G') and the loss tangent (tan δ) of the resin are measured using the instrument with a parallel cone having a diameter of 20 mm under the following conditions:
   Frequency: 1.0 Hz
   Temperature rising speed 2.0° C./min
   Strain: 0.1% (automatic strain control, allowable minimum stress: 1.0 g/cm, allowable maximum stress: 500 g/cm, maximum applied strain: 200%, strain adjustment 200%)

GAP: The GAP was controlled by an operator such that "FORCE" in a PC screen falls in a range of from 0 to 100 gm after setting the sample.

The temperature (i.e., the loss tangent peak temperature), at which a loss tangent peak is observed, and the peak value of the loss tangent peak was determined. In this regard, the data of the loss tangent obtained when the storage modulus (G') is not greater than 10 are excluded.

(5) Molecular Weights (Mw and Mn)

The number average molecular weight (Mn) and the weight average molecular weight (Mw) of tetrahydrofuran-soluble components of a resin were measured with a combination of an instrument using gel permeation chromatography (GPC), GPC-150C (Waters Corp.) and columns KF801-807 from Showa Denko K.K. The measuring method is as follows.

1) The columns are stabilized at 40° C. in a heat chamber;
2) Tetrahydrofuran is fed to the columns at a flow rate of 1 ml/min;
3) 0.05 g of a sample (resin) is dissolved in 5 g of tetrahydrofuran and the solution is filtered using a filter (such as filters having pore size of 0.45 μm (e.g., CHOROMATODISK from Kurabo Industries Ltd.), and then diluted to prepare a THF solution of the resin having a solid content of from 0.05 to 0.6% by weight;
4) 50 to 200 μl of the solution is fed to the columns to measure the weight average molecular weight (Mw) and the number average molecular weight (Mn) of the resin using a working curve showing relation between counts and amounts and prepared by using monodisperse polystyrenes.

The monodisperse polystyrenes prepared by Tosoh Corp., and having different molecular weights, $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, were used for preparing the working curve. In measurements, a RI (refractive index) detector was used as the detector.

The formula and properties of each of the polyester resins A-F are shown in Table 1 below.

TABLE 1

| Formula and properties of polyester resins | | Polyester resins A | B | C | D | E | F |
|---|---|---|---|---|---|---|---|
| Alcoholic components | BPA-PO (% by mole) | 55 | — | — | 57 | 70 | — |
| | BPA-EO (% by mole) | — | 55 | 35 | — | — | 30 |
| | Ethylene glycol (% by mole) | 40 | 40 | 55 | 38 | 30 | 50 |
| | Glycerin (% by mole) | 5 | 5 | 10 | 5 | — | 20 |
| Acid components | Adipic acid (% by mole) | 5 | 5 | 30 | — | — | 35 |
| | Terephthalic acid (% by mole) | 55 | 55 | 40 | 55 | 45 | 35 |
| | Isophthalic acid (% by mole) | 40 | 40 | 30 | 40 | 40 | 30 |
| | Trimellitic acid (% by mole) | — | — | — | 5 | 15 | — |
| Properties | Softening point (° C.) | 122.5 | 120.8 | 107.4 | 128.1 | 139.2 | 103.5 |
| | Tg (° C.) | 62.4 | 60.3 | 53.4 | 67.9 | 73.4 | 47.7 |
| | Tan δ peak temp. (° C.) | 140 | 137 | 82 | 162 | No peak | 78 |
| | Tan δ | 22 | 26 | 16 | 15 | — | 14 |
| | AV (mgKOH/g) | 7.2 | 6.8 | 5.4 | 8.4 | 8.9 | 4.8 |
| | Mw | 20480 | 19840 | 15840 | 27750 | 34310 | 14270 |
| | Mn | 4340 | 3580 | 3050 | 4820 | 5340 | 2840 |
| | Mw/Mn | 4.7 | 5.5 | 5.2 | 5.8 | 6.4 | 5.0 |

2. Preparation of Crystalline Polyester Resins A and B 2-1. Preparation of Crystalline Polyester Resin A The following components were fed into a 5-liter four-necked round-bottom flask equipped with a thermometer, an agitator, a condenser and a nitrogen feed pipe to be mixed.

Alcoholic Components

| | |
|---|---|
| 1,4-Butanediol | 100% by mole |

Carboxylic Acid Components

| | |
|---|---|
| Fumaric acid | 90% by mole |
| Succinic acid | 5% by mole |
| Trimellitic acid | 5% by mole |

In this regard, the molar ratio of the alcoholic components to the carboxylic acid components was 1/1.

The total weight of these components was 4,000 g. In addition, 4 g of hydroquinone was added thereto.

After the flask was set in a mantle heater while a nitrogen gas was fed into the flask so that the atmosphere inside the flask was changed to inert atmosphere, the flask was heated to 160° C. to perform a reaction for 5 hours, followed by a reaction for 1 hour at 200° C., and a further reaction for 1 hour at 200° C. under a pressure of 8.3 kPa. Thus, a crystalline polyester resin A was prepared.

2-2 Preparation of Crystalline Polyester Resin B

The procedure for preparation of the crystalline polyester resin A was repeated except that the alcoholic components and the carboxylic acid components were changed as follows.

Alcoholic Components

| | |
|---|---|
| 1,5-Pentanediol | 90% by mole |
| 1,6-hexanediol | 10% by mole |

Carboxylic Acid Components

| | |
|---|---|
| Succinic acid | 5% by mole |
| Trimellitic acid | 5% by mole |
| Terephthalic acid | 90% by mole |

Thus, a crystalline polyester resin B was prepared.

The thus prepared crystalline polyester resins A and B were evaluated as follows.

(1) Melting Point

A differential scanning calorimeter (DSC), DSC210 from Seiko instruments Inc., was used to measure the melting point of a crystalline polyester resin. Specifically, 0.01 to 0.02 g of a resin was set on an aluminum pan, and the resin was heated to 150° C. in the differential scanning calorimeter at a temperature rising speed of 10° C./m while recording a DSC curve. The melting point was determined as the temperature, at which the maximum endothermic peak is observed.

(2) Molecular Weights (Mw and Mn)

The weight average molecular weight (Mw) and the number average molecular weight of a crystalline polyester resin were determined by the method mentioned above.

The formula and properties of each of the crystalline polyester resins A and B are shown in Table 2 below.

TABLE 2

| Formula and property of crystalline polyester resins | | Crystalline polyester A | Crystalline polyester B |
|---|---|---|---|
| Alcoholic components | 1,4-butanediol (% by mole) | 100 | — |
| | 1,5-pentanediol (% by mole) | — | 90 |
| | 1,6-hexanediol (% by mole) | — | 10 |
| Carboxylic acid components | Fumaric acid (% by mole) | 90 | — |
| | Succinic acid (% by mole) | 5 | 5 |
| | Trimellitic acid (% by mole) | 5 | 5 |
| | Terephthalic acid (% by mole) | — | 90 |
| Melting point (° C.) | | 105 | 135 |
| Weight average molecular weight (Mw) | | 6370 | 10450 |
| Number average molecular weight (Mn) | | 1510 | 3860 |

3. Preparation of Transparent Toners 3-1 Preparation of Transparent Toner 1

The following components were mixed using a HENSCHEL MIXER mixer (FM20B from NIPPON COKE & ENGINEERING CO., LTD.).

| | |
|---|---|
| Polyester resin A | 90 parts |
| Crystalline polyester resin A | 10 parts |
| Charge controlling agent (metal complex of salicylic acid, BONTRON E-84 from Orient Chemical Industries Co., Ltd.) | 2 parts |

The toner component mixture was kneaded in a temperature range of from 100 to 130° C. using a twin-screw extruder, PCM-30 from Ikegai Corp. After the kneaded toner component mixture was cooled to room temperature, the solidified toner component mixture was crushed using a hammer mill so as to have a particle size of from 200 μm to 300 μm. The crushed toner component mixture was pulverized using a supersonic jet pulverizer (LABOJET from Nippon Pneumatic Mfg. Co., Ltd.) while controlling the air pressure, followed by classification using an airflow classifier (MDS-1 from Nippon Pneumatic Mfg. Co., Ltd.) while controlling the angle of the louver so that the resultant toner particles have a weight average particle diameter of 6.0±0.2 μm, and a ratio (Dw/Dn) (weight average particle diameter (Dw)/number average particle diameter (Dn)) of not greater than 1.20. Thus, a mother toner (i.e., toner particles) of a transparent toner 1 was prepared.

The following components were mixed using a HENSCHEL MIXER mixer.

| | |
|---|---|
| Mother toner of the transparent toner 1 prepared above | 100 parts |
| External additive (silica, HDK-2000 from Clariant Japan K.K.) | 1.0 part |
| External additive (silica, H05TD from Wacher Chemie AG) | 1.0 part |

Thus, the transparent toner 1 was prepared.

3-2 Preparation of Transparent Toner 2

The procedure for preparation of the transparent toner 1 was repeated except that the polyester resin A was replaced with 90 parts of the polyester resin B, and the crystalline polyester resin A was replaced with 10 parts of the crystalline polyester resin B.

Thus, a transparent toner 2 was prepared.

3-3 Preparation of Transparent Toner 3

The procedure for preparation of the transparent toner 1 was repeated except that the polyester resin A was replaced with 98.5 parts of the polyester resin C, and the added amount of the crystalline polyester resin A was changed from 10 parts to 1.5 parts.

Thus, a transparent toner 3 was prepared.

3-4 Preparation of Transparent Toner 4

The procedure for preparation of the transparent toner 1 was repeated except that the polyester resin A was replaced with 100 parts of the polyester resin D, and the added amount of the crystalline polyester resin A was changed from 10 parts to 0 part (i.e., the crystalline polyester resin A was not added).

Thus, a transparent toner 4 was prepared.

3-5 Preparation of Transparent Toner 5

The procedure for preparation of the transparent toner 1 was repeated except that the polyester resin A was replaced with 99 parts of the polyester resin E, and the crystalline polyester resin A was replaced with 1 part of the crystalline polyester resin B.

Thus, a transparent toner 5 was prepared.

3-6 Preparation of Transparent Toner 6

The procedure for preparation of the transparent toner 1 was repeated except that the polyester resin A was replaced with 88 parts of the polyester resin F, and 2 parts of a higher aliphatic alcohol serving as a lubricant was added.

Thus, a transparent toner 6 was prepared.

3-7 Preparation of Transparent Toner 7

The procedure for preparation of the transparent toner 1 was repeated except that the polyester resin A was replaced with 82 parts of the polyester resin B, the added amount of the crystalline polyester resin was changed from 10 parts to 15 parts, and 3 parts of stearamide serving as a lubricant was added.

Thus, a transparent toner 7 was prepared.

3-8 Preparation of Transparent Toner 8

The procedure for preparation of the transparent toner 1 was repeated except that the polyester resin A was replaced with 78 parts of the polyester resin C, the added amount of the crystalline polyester resin was changed from 10 parts to 20 parts, and 2 parts of N,N'-ethylene-bisstearamide serving as a lubricant was added.

Thus, a transparent toner 8 was prepared.

The formula of each of the transparent toners 1-8 is shown in Table 3 below.

TABLE 3

| Trans-parent toner | Polyester resin (parts by weight) A | B | C | D | E | F | Crystalline polyester resin (parts by weight) A | B | Lubricant (parts by weight) |
|---|---|---|---|---|---|---|---|---|---|
| 1 | 90 | — | — | — | — | — | 10 | — | No |
| 2 | — | 90 | — | — | — | — | — | 10 | No |
| 3 | — | — | 98.5 | — | — | — | 1.5 | — | No |
| 4 | — | — | — | 100 | — | — | — | — | No |
| 5 | — | — | — | — | 99 | — | — | 1 | No |
| 6 | — | — | — | — | — | 88 | 10 | — | HAA* (2) |
| 7 | — | 82 | — | — | — | — | 15 | — | SA*2 (3) |
| 8 | — | — | 78 | — | — | — | 20 | — | EBSA*3 (2) |

HAA*: Higher aliphatic alcohol
SA*2: Stearamide
EBSA*3: N,N'-ethylene-bisstearamide 4. Preparation of Color Toners (Preparation of Colorant Master Batches)

The following components were mixed using a HENSCHEL MIXER mixer from NIPPON COKE & ENGINEERING CO., LTD.

| | |
|---|---|
| Carbon black (REGAL 400R from Cabot Corp.) | 50 parts |

-continued

| | |
|---|---|
| Polyester resin (RS801 from Sanyo Chemical Industries Ltd.) | 50 parts |
| Water | 30 parts |

The mixture was kneaded for 50 minutes at 160° C. using a two roll mill. The kneaded mixture was subjected to roll cooling, and then pulverized. Thus, a black colorant master batch 1 was prepared.

The procedure for preparation of the black colorant master batch 1 was repeated except that the carbon black was replaced with C.I. Pigment Red 269, C.I. Pigment Blue 15:3, or C.I. Pigment Yellow 155 to prepare a magenta colorant master batch 1, a cyan colorant master batch 1 and a yellow colorant master batch 1.

4-1 Preparation of Black Toner 1

(Preparation of Aqueous Phase Liquid)

The following components were mixed.

| | |
|---|---|
| Water | 100 parts |
| Aqueous dispersion of vinyl resin (Copolymer of styrene/methacrylic acid/butyl acrylate/sodium salt of sulfate of ethylene oxide adduct of methacrylic acid prepared by Sanyo Chemical Industries Ltd., solid content of 20% by weight) | 10 parts |
| Aqueous solution of sodium salt of dodecyldiphenyletherdisulfonic acid (ELEMINOL MON-7 from Sanyo Chemical Industries Ltd., solid content of 50%) | 20 parts |
| 1% aqueous solution of polymeric protective colloid (Carboxymethyl cellulose, CELLOGEN BSH from Dai-ichi Kogyo Seiyaku Co., Ltd.) | 40 parts |
| Ethyl acetate | 15 parts |

Thus, a milk white liquid serving as an aqueous phase liquid 1 was prepared.

(Preparation of Urethane/Urea-Modified Polyester Resin)

The following components were fed in a four-necked flask equipped with a nitrogen feed pipe, a dewatering conduit, an agitator, and a thermocouple.

| | |
|---|---|
| 50% ethyl acetate solution of prepolymer (Reaction product of isophorone diisocyanate with a condensate of a propylene oxide adduct of bisphenol A, an ethylene oxide adduct of bisphenol A, adipic acid, and terephthalic acid, which is prepared by Sanyo Chemical Industries Ltd. and which has a Mn of 6,500, a Mw of 18,000, and a Tg of 55° C., while including free isocyanate in an amount of 1.5% by weight) | 400 g |
| Condensate of a propylene oxide adduct of bisphenol A with adipic acid (having a Mn of 800) | 100 g |
| Isophorone diamine | 20 g |
| Ethyl acetate | 50 g |

The mixture was heated to 100° C. in a nitrogen atmosphere while agitated to be reacted. After the reaction was performed for 5 hours, ethyl acetate was removed from the reaction product under a reduced pressure. Thus, a urethane/urea modified polyester resin 1, which has a urethane group and/or a urea group, was prepared. It was confirmed that the urethane/urea modified polyester resin 1 has a softening point of 104° C., a Tg of 60° C., an acid value of 18 mgKOH/g, and a hydroxyl value of 45 mgKOH/g.

(Preparation of Black Toner 1)

The following components were fed into a container equipped with an agitator and a thermometer.

| | |
|---|---|
| Urethane/urea modified polyester resin 1 prepared above | 500 parts |
| Carnauba wax | 40 parts |
| Ethyl acetate | 200 parts |

The mixture was heated to 80° C. while agitated. After the mixture was heated for 5 hours at 80° C., the mixture was cooled to 30° C. over 1 hour, and then subjected to a dispersing treatment using a bead mill (ULTRAVISCOMILL from Aimex Co., Ltd.). The dispersing conditions were as follows.

Liquid feeding speed: 1.2 kg/hour

Peripheral speed of disc: 10 msec

Dispersing media: zirconia beads with a diameter of 0.5 mm

Filling factor of beads: 80% by volume

Repeat number of dispersing operation: 5 times (5 passes)

Thus, a wax dispersion was prepared.

Next, the following components were fed into a container equipped with an agitator, and a thermometer.

| | |
|---|---|
| Wax dispersion prepared above | 740 parts |
| Urethane/urea modified polyester resin 1 prepared above | 420 parts |
| Black master batch 1 prepared above | 160 parts |
| Ethyl acetate | 100 parts |

The mixture was subjected to a dispersing treatment using a bead mill (ULTRAVISCOMILL from Aimex Co., Ltd.). The dispersing conditions were as follows.

Liquid feeding speed: 1.2 kg/hour

Peripheral speed of disc: 10 msec

Dispersing media: zirconia beads with a diameter of 0.5 mm

Filling factor of beads: 80% by volume

Repeat number of dispersing operation: 5 times (5 passes)

Thus, a pigment/wax dispersion 1 was prepared.

The following components were fed in a container.

| | |
|---|---|
| Aqueous phase liquid 1 prepared above | 1420 parts |
| Pigment/wax dispersion 1 prepared above | 1420 parts |
| Emulsion stabilizer (UCAT660M from Sanyo Chemical Industries Ltd.) | 5 parts |

The mixture was agitated for 30 minutes at 28° C. using a TK HOMOMIXER mixer from Primix Corp., whose rotor was rotated at a revolution of 9,000 rpm. Thus, a slurry-like emulsion was prepared.

The slurry-like emulsion was fed into a container equipped with an agitator and a thermometer, and agitated for 10 hours at 35° C., followed by aging for 12 hours at 45° C. to remove the organic solvent therefrom. Thus, a black particle dispersion was prepared One hundred (100) parts of the thus prepared black particle dispersion was filtered under a reduced pressure.

The thus prepared wet cake was mixed with 300 parts of ion-exchange water, and the mixture was agitated for 15 minutes with a TK HOMOMIXER mixer from Primix Corp., whose rotor was rotated at a revolution of 6,000 rpm, followed by filtration under a reduced pressure. Thus, a wet cake (a) was prepared.

The thus prepared wet cake (a) was mixed with 100 parts of a 10% aqueous solution of sodium hydroxide, and the mixture was agitated for 15 minutes with the TK HOMOMIXER mixer, whose rotor was rotated at a revolution of 6,000 rpm, followed by filtration under a reduce pressure. Thus, a wet cake (b) was prepared. The wet cake (b) was mixed with 100 parts of a 10% aqueous solution of hydrochloric acid, and the mixture was agitated for 15 minutes with the TK HOMOMIXER mixer, whose rotor was rotated at a revolution of 6,000 rpm, followed by filtration under a reduce pressure. Thus, a wet cake (c) was prepared. The wet cake (c) was mixed with 500 parts of ion-exchange water, and the mixture was agitated for 30 minutes with the TK HOMOMIXER mixer, whose rotor was rotated at a revolution of 6,000 rpm, followed by filtration under a reduced pressure to prepare a wet cake.

The thus prepared wet cake was dried for 24 hours at 40° C. using a circulating air drier, followed by sieving with a screen having openings of 75 μm.

Thus, a mother toner 1 of a black toner (black mother toner 1) having a weight average particle diameter of 5.0 μm and a Mw/Mn ratio of 1.13 was prepared.

One hundred (100) parts of the black mother toner 1 was mixed with 1.0 part of an external additive (silica, HDK-2000 from Clariant Japan K.K.) and 1.0 part of another external additive ((silica, H05TD from Wacker Chemie AG) using a HENSCHEL MIXER mixer.

Thus, a black toner 1 was prepared.

4-2 Preparation of Black Toner 2

(Preparation of Aqueous Phase Liquid)

The aqueous phase liquid 1 prepared above was used.

(Preparation of Black Toner 2)

The following components were fed into a container equipped with an agitator and a thermometer.

| | |
|---|---|
| Polyester resin (having a Tg of 64° C., a Mw of 15,300, a Mn of 3,800, an acid value of 7 mgKOH/g) | 250 parts |
| Carnauba wax | 40 parts |
| Ethyl acetate | 200 parts |

The mixture was heated to 80° C. while agitated. After the mixture was heated for 5 hours at 80° C., the mixture was cooled to 30° C. over 1 hour, and then subjected to a dispersing treatment using a bead mill (ULTRAVISCOMILL from Aimex Co., Ltd.). The dispersing conditions were as follows.

Liquid feeding speed: 1.2 kg/hour

Peripheral speed of disc: 10 msec

Dispersing media: zirconia beads with a diameter of 0.5 mm

Filling factor of beads: 80% by volume

Repeat number of dispersing operation: 5 times (5 passes)

Thus, a wax dispersion was prepared.

Next, the following components were fed into a container equipped with an agitator, and a thermometer.

| | |
|---|---|
| Wax dispersion prepared above | 490 parts |
| Polyester resin mentioned above (having a Tg of 64° C., a Mw of 15,300, a Mn of 3,800, an acid value of 7 mgKOH/g) | 520 parts |
| Black master batch 1 prepared above | 160 parts |
| Ethyl acetate | 100 parts |

The mixture was subjected to a dispersing treatment using a bead mill (ULTRAVISCOMILL from Aimex Co., Ltd.). The dispersing conditions were as follows.

Liquid feeding speed: 1.2 kg/hour

Peripheral speed of disc: 10 msec

Dispersing media: zirconia beads with a diameter of 0.5 mm

Filling factor of beads: 80% by volume

Repeat number of dispersing operation: 5 times (5 passes)

Thus, a pigment/wax dispersion 2 was prepared.

The following components were fed in a container.

| | |
|---|---|
| Aqueous phase liquid 1 prepared above | 1420 parts |
| Pigment/wax dispersion 2 prepared above | 1270 parts |
| 50% ethyl acetate solution of prepolymer (Reaction product of isophorone diisocyanate with a condensate of a propylene oxide adduct of bisphenol A, an ethylene oxide adduct of bisphenol A, adipic acid, and terephthalic acid, which is prepared by Sanyo Chemical Industries Ltd. and which has a Mn of 6,500, a Mw of 18,000, and a Tg of 55° C., while including a free isocyanate in an amount of 1.5% by weight) | 150 parts |
| Isobutyl alcohol | 1 part |
| Isophorone diamine | 7 parts |
| Emulsion stabilizer (UCAT660M from Sanyo Chemical Industries Ltd.) | 5 parts |

The mixture was agitated for 30 minutes at 28° C. using a TK HOMOMIXER mixer from Primix Corp., whose rotor was rotated at a revolution of 9,000 rpm. Thus, an emulsion was prepared.

The emulsion was heated to 58° C., and agitated for 1 hour using a TK HOMOMIXER mixer from Primix Corp., whose rotor was rotated at a revolution of 1,500 rpm. Thus, a slurry-like emulsion was prepared.

The slurry-like emulsion was fed into a container equipped with an agitator and a thermometer, and agitated for 10 hours at 35° C., followed by aging for 12 hours at 45° C. to remove the organic solvent therefrom. Thus, a black particle dispersion was prepared One hundred (100) parts of the thus prepared black particle dispersion was filtered under a reduced pressure.

The thus prepared wet cake was mixed with 300 parts of ion-exchange water, and the mixture was agitated for 15 minutes with a TK HOMOMIXER mixer from Primix Corp., whose rotor was rotated at a revolution of 6,000 rpm, followed by filtration under a reduced pressure. Thus, a wet cake (a) was prepared.

The thus prepared wet cake (a) was mixed with 100 parts of a 10% aqueous solution of sodium hydroxide, and the mixture was agitated for 15 minutes with the TK HOMOMIXER mixer, whose rotor was rotated at a revolution of 6,000 rpm, followed by filtration under a reduce pressure. Thus, a wet cake (b) was prepared. The wet cake (b) was mixed with 100 parts of a 10% aqueous solution of hydrochloric acid, and the mixture was agitated for 15 minutes with the TK HOMOMIXER mixer, whose rotor was rotated at a revolution of 6,000 rpm, followed by filtration under a reduce pressure. Thus, a wet cake (c) was prepared. The wet cake (c) was mixed with 500 parts of ion-exchange water, and the mixture was agitated for 30 minutes with the TK HOMOMIXER mixer, whose rotor was rotated at a revolution of 6,000 rpm, followed by filtration under a reduced pressure to prepare a wet cake.

The thus prepared wet cake was dried for 24 hours at 40° C. using a circulating air drier, followed by sieving with a screen having openings of 75 μm.

Thus, a mother toner 2 of a black toner (black mother toner 2) having a weight average particle diameter of 5.2 μm and a Mw/Mn ratio of 1.14 was prepared.

One hundred (100) parts of the black mother toner 2 was mixed with 1.0 part of an external additive (silica, HDK-2000 from Clariant Japan K.K.) and 1.0 part of another external additive (silica, H05TD from Wacher Chemie AG) using a HENSCHEL MIXER mixer.

Thus, a black toner 2 was prepared.

4-3 Preparation of Black Toner 3

(Preparation of Aqueous Phase Liquid)

The aqueous phase liquid 1 prepared above was used.

(Preparation of Black Toner 3)

The following components were fed into a container equipped with an agitator and a thermometer.

| | |
|---|---|
| Polyester resin mentioned above (having a Tg of 59° C., a Mw of 10,800, a Mn of 2,800, an acid value of 8 mgKOH/g) | 230 parts |
| Crystalline polyester resin mentioned above (having a softening point of 95° C.) | 20 parts |
| Carnauba wax | 40 parts |
| Ethyl acetate | 200 parts |

The mixture was heated to 80° C. while agitated. After the mixture was heated for 5 hours at 80° C., the mixture was cooled to 30° C. over 1 hour, and then subjected to a dispersing treatment using a bead mill (ULTRAVISCOMILL from Aimex Co., Ltd.). The dispersing conditions were as follows.

Liquid feeding speed: 1.2 kg/hour

Peripheral speed of disc: 10 msec

Dispersing media: zirconia beads with a diameter of 0.5 mm

Filling factor of beads: 80% by volume

Repeat number of dispersing operation: 5 times (5 passes)

Thus, a wax dispersion was prepared.

Next, the following components were fed into a container equipped with an agitator, and a thermometer.

| | |
|---|---|
| Wax dispersion prepared above | 490 parts |
| Polyester resin mentioned above (having a Tg of 59° C., a Mw of 10,800, a Mn of 2,800, an acid value of 8 mgKOH/g) | 470 parts |
| Crystalline polyester resin mentioned above (having a softening point of 95° C.) | 50 parts |
| Black master batch 1 prepared above | 160 parts |
| Ethyl acetate | 100 parts |

The mixture was subjected to a dispersing treatment using a bead mill (ULTRAVISCOMILL from Aimex Co., Ltd.). The dispersing conditions were as follows.

Liquid feeding speed: 1.2 kg/hour

Peripheral speed of disc: 10 msec

Dispersing media: zirconia beads with a diameter of 0.5 mm

Filling factor of beads: 80% by volume

Repeat number of dispersing operation: 5 times (5 passes)

Thus, a pigment/wax dispersion 3 was prepared.

The following components were fed in a container.

| | |
|---|---|
| Aqueous phase liquid 1 prepared above | 1420 parts |
| Pigment/wax dispersion 3 prepared above | 1270 parts |
| 50% ethyl acetate solution of prepolymer (Reaction product of isophorone diisocyanate with a condensate of a propylene oxide adduct of bisphenol A, an ethylene oxide adduct of bisphenol A, adipic acid, and terephthalic acid, which is prepared by Sanyo Chemical Industries Ltd. and which has a Mn of 6,500, a Mw of 18,000, and a Tg of 55° C., while including free isocyanate in an amount of 1.5% by weight) | 150 parts |

-continued

| | |
|---|---|
| Isobutyl alcohol | 1 part |
| Isophorone diamine | 7 parts |
| Emulsion stabilizer (UCAT660M from Sanyo Chemical Industries Ltd.) | 5 parts |

The mixture was agitated for 30 minutes at 28° C. using a TK HOMOMIXER mixer from Primix Corp., whose rotor was rotated at a revolution of 9,000 rpm. Thus, an emulsion was prepared.

The emulsion was heated to 58° C., and agitated for 1 hour using a TK HOMOMIXER mixer from Primix Corp., whose rotor was rotated at a revolution of 1,500 rpm. Thus, a slurry-like emulsion was prepared.

The slurry-like emulsion was fed into a container equipped with an agitator and a thermometer, and agitated for 10 hours at 35° C., followed by aging for 12 hours at 45° C. to remove the organic solvent therefrom. Thus, a black particle dispersion was prepared One hundred (100) parts of the thus prepared black particle dispersion was filtered under a reduced pressure.

The thus prepared wet cake was mixed with 300 parts of ion-exchange water, and the mixture was agitated for 15 minutes with a TK HOMOMIXER mixer from Primix Corp., whose rotor was rotated at a revolution of 6,000 rpm, followed by filtration under a reduced pressure. Thus, a wet cake (a) was prepared.

The thus prepared wet cake (a) was mixed with 100 parts of a 10% aqueous solution of sodium hydroxide, and the mixture was agitated for 15 minutes with the TK HOMOMIXER mixer, whose rotor was rotated at a revolution of 6,000 rpm, followed by filtration under a reduce pressure. Thus, a wet cake (b) was prepared. The wet cake (b) was mixed with 100 parts of a 10% aqueous solution of hydrochloric acid, and the mixture was agitated for 15 minutes with the TK HOMOMIXER mixer, whose rotor was rotated at a revolution of 6,000 rpm, followed by filtration under a reduce pressure. Thus, a wet cake (c) was prepared. The wet cake (c) was mixed with 500 parts of ion-exchange water, and the mixture was agitated for 30 minutes with the TK HOMOMIXER mixer, whose rotor was rotated at a revolution of 6,000 rpm, followed by filtration under a reduced pressure to prepare a wet cake.

The thus prepared wet cake was dried for 24 hours at 40° C. using a circulating air drier, followed by sieving with a screen having openings of 75 μm.

Thus, a mother toner 3 of a black toner (black mother toner 3) having a weight average particle diameter of 5.2 μm and a Mw/Mn ratio of 1.14 was prepared.

One hundred (100) parts of the black mother toner 3 was mixed with 1.0 part of an external additive (silica, HDK-2000 from Clariant Japan K.K.) and 1.0 part of another external additive (silica, H05TD from Wacker Chemie AG) using a HENSCHEL MIXER mixer.

Thus, a black toner 3 was prepared.

4-4 Preparation of Black Toner 4

The procedure for preparation of the transparent toner 1 was repeated except the following components were used.

| | |
|---|---|
| Polyester resin (having a Tg of 67° C., a Mw of 25,300, a Mn of 3,800, an acid value of 25 mgKOH/g) | 92 parts |
| Carnauba wax (Carnauba wax No.1 from CERARICA NODA Co., Ltd.) | 4 parts |

-continued

| | |
|---|---|
| Charge controlling agent (metal complex of salicylic acid, BONTRON E-84 from Orient Chemical Industries Co., Ltd.) | 2 parts |
| Black master batch 1 prepared above | 15 parts |

Thus, a black toner 4 was prepared.

4-5 Preparation of Black Toner 5

The procedure for preparation of the transparent toner 1 was repeated except the following components were used.

| | |
|---|---|
| Polyester resin (having a Tg of 57° C., a Mw of 8,300, a Mn of 1,800, an acid value of 5 mgKOH/g) | 92 parts |
| Carnauba wax (Carnauba wax No.1 from CERARICA NODA Co., Ltd.) | 4 parts |
| Charge controlling agent (BONTRON E-84 from Orient Chemical Industries Co., Ltd.) | 2 parts |
| Black master batch 1 prepared above | 15 parts |

Thus, a black toner 5 was prepared.

4-6 Preparation of Black Toner 6

(Preparation of Aqueous Phase Liquid)

The aqueous phase liquid 1 prepared above was used.

(Preparation of Black Toner 6)

The following components were fed into a container equipped with an agitator and a thermometer.

| | |
|---|---|
| Polyester resin (having a Tg of 59° C., a Mw of 10,800, a Mn of 2,800, an acid value of 8 mgKOH/g) | 230 parts |
| Carnauba wax | 40 parts |
| Ethyl acetate | 200 parts |

The mixture was heated to 80° C. while agitated. After the mixture was heated for 5 hours at 80° C., the mixture was cooled to 30° C. over 1 hour, and then subjected to a dispersing treatment using a bead mill (ULTRAVISCOMILL from Aimex Co., Ltd.). The dispersing conditions were as follows.

Liquid feeding speed: 1.2 kg/hour

Peripheral speed of disc: 10 msec

Dispersing media: zirconia beads with a diameter of 0.5 mm

Filling factor of beads: 80% by volume

Repeat number of dispersing operation: 5 times (5 passes)

Thus, a wax dispersion was prepared.

Next, the following components were fed into a container equipped with an agitator, and a thermometer.

| | |
|---|---|
| Wax dispersion prepared above | 510 parts |
| Polyester resin mentioned above (having a Tg of 59° C., a Mw of 10,800, a Mn of 2,800, an acid value of 8 mgKOH/g) | 420 parts |
| Black master batch 1 prepared above | 160 parts |
| Ethyl acetate | 100 parts |

The mixture was subjected to a dispersing treatment using a bead mill (ULTRAVISCOMILL from Aimex Co., Ltd.). The dispersing conditions were as follows.

Liquid feeding speed: 1.2 kg/hour

Peripheral speed of disc: 10 msec

Dispersing media: zirconia beads with a diameter of 0.5 mm

Filling factor of beads: 80% by volume

Repeat number of dispersing operation: 5 times (5 passes)

Thus, a pigment/wax dispersion 6 was prepared.

The following components were fed in a container.

| | |
|---|---|
| Aqueous phase liquid 1 prepared above | 1250 parts |
| Pigment/wax dispersion 6 prepared above | 1130 parts |
| Isobutyl alcohol | 1 part |
| Isophorone diamine | 7 parts |
| Emulsion stabilizer (UCAT660M from Sanyo Chemical Industries Ltd.) | 5 parts |

The mixture was agitated for 30 minutes at 28° C. using a TK HOMOMIXER mixer from Primix Corp., whose rotor was rotated at a revolution of 9,000 rpm. Thus, an emulsion was prepared.

The emulsion was heated to 58° C., and agitated for 1 hour using a TK HOMOMIXER mixer from Primix Corp., whose rotor was rotated at a revolution of 1,500 rpm. Thus, a slurry-like emulsion was prepared.

The slurry-like emulsion was fed into a container equipped with an agitator and a thermometer, and agitated for 10 hours at 35° C., followed by aging for 12 hours at 45° C. to remove the organic solvent therefrom. Thus, a black particle dispersion was prepared One hundred (100) parts of the thus prepared black particle dispersion was filtered under a reduced pressure.

The thus prepared wet cake was mixed with 300 parts of ion-exchange water, and the mixture was agitated for 15 minutes with a TK HOMOMIXER mixer from Primix Corp., whose rotor was rotated at a revolution of 6,000 rpm, followed by filtration under a reduced pressure. Thus, a wet cake (a) was prepared.

The thus prepared wet cake (a) was mixed with 100 parts of a 10% aqueous solution of sodium hydroxide, and the mixture was agitated for 15 minutes with the TK HOMOMIXER mixer, whose rotor was rotated at a revolution of 6,000 rpm, followed by filtration under a reduce pressure. Thus, a wet cake (b) was prepared. The wet cake (b) was mixed with 100 parts of a 10% aqueous solution of hydrochloric acid, and the mixture was agitated for 15 minutes with the TK HOMOMIXER mixer, whose rotor was rotated at a revolution of 6,000 rpm, followed by filtration under a reduce pressure. Thus, a wet cake (c) was prepared. The wet cake (c) was mixed with 500 parts of ion-exchange water, and the mixture was agitated for 30 minutes with the TK HOMOMIXER mixer, whose rotor was rotated at a revolution of 6,000 rpm, followed by filtration under a reduced pressure to prepare a wet cake.

The thus prepared wet cake was dried for 24 hours at 40° C. using a circulating air drier, followed by sieving with a screen having openings of 75 μm.

Thus, a mother toner 6 of a black toner (black mother toner 6) having a weight average particle diameter of 5.2 μm and a Mw/Mn ratio of 1.14 was prepared.

One hundred (100) parts of the black mother toner 6 was mixed with 1.0 part of an external additive (silica, HDK-2000 from Clariant Japan K.K.) and 1.0 part of another external additive (silica, H05TD from Wacker Chemie AG) using a HENSCHEL MIXER mixer.

Thus, a black toner 6 was prepared.

4-7 Preparation of Black, Magenta, Cyan and Yellow Toners 4-7-1 Preparation of Black Toner 7

(Preparation of Aqueous Phase Liquid)

The aqueous phase liquid 1 prepared above was used.

(Preparation of Black Toner 7)

The following components were fed into a container equipped with an agitator and a thermometer.

| | |
|---|---|
| Polyester resin (having a Tg of 60° C., a Mw of 11,300, a Mn of 3,200, an acid value of 13 mgKOH/g) | 250 parts |
| Carnauba wax | 35 parts |
| Ethyl acetate | 200 parts |

The mixture was heated to 80° C. while agitated. After the mixture was heated for 5 hours at 80° C., the mixture was cooled to 30° C. over 1 hour, and then subjected to a dispersing treatment using a bead mill (ULTRAVISCOMILL from Aimex Co., Ltd.). The dispersing conditions were as follows.

Liquid feeding speed: 1.2 kg/hour

Peripheral speed of disc: 10 msec

Dispersing media: zirconia beads with a diameter of 0.5 mm

Filling factor of beads: 80% by volume

Repeat number of dispersing operation: 5 times (5 passes)

Thus, a wax dispersion was prepared.

Next, the following components were fed into a container equipped with an agitator, and a thermometer.

| | |
|---|---|
| Wax dispersion prepared above | 490 parts |
| Polyester resin mentioned above (having a Tg of 60° C., a Mw of 11,300, a Mn of 3,200, an acid value of 13 mgKOH/g) | 520 parts |
| Black master batch 1 prepared above | 160 parts |
| Ethyl acetate | 100 parts |

The mixture was subjected to a dispersing treatment using a bead mill (ULTRAVISCOMILL from Aimex Co., Ltd.). The dispersing conditions were as follows.

Liquid feeding speed: 1.2 kg/hour

Peripheral speed of disc: 10 msec

Dispersing media: zirconia beads with a diameter of 0.5 mm

Filling factor of beads: 80% by volume

Repeat number of dispersing operation: 5 times (5 passes)

Thus, a pigment/wax dispersion 7 was prepared.

The following components were fed in a container.

| | |
|---|---|
| Aqueous phase liquid prepared above | 1420 parts |
| Pigment/wax dispersion 7 prepared above | 1270 parts |
| 50% ethyl acetate solution of prepolymer (from Sanyo Chemical Industries Ltd. and which has a Mn of 6,300, and a Tg of 53° C., while including free isocyanate in an amount of 1.5% by weight) | 150 parts |
| Isobutyl alcohol | 1 part |
| Isophorone diamine | 7 parts |
| Emulsion stabilizer (UCAT660M from Sanyo Chemical Industries Ltd.) | 5 parts |

The mixture was agitated for 30 minutes at 28° C. using a TK HOMOMIXER mixer from Primix Corp., whose rotor was rotated at a revolution of 9,000 rpm. Thus, an emulsion was prepared.

The emulsion was heated to 58° C., and agitated for 1 hour using a TK HOMOMIXER mixer from Primix Corp., whose rotor was rotated at a revolution of 1,500 rpm. Thus, a slurry-like emulsion was prepared.

The slurry-like emulsion was fed into a container equipped with an agitator and a thermometer, and agitated for 10 hours at 35° C., followed by aging for 12 hours at 45° C. to remove the organic solvent therefrom. Thus, a black particle dispersion was prepared One hundred (100) parts of the thus prepared black particle dispersion was filtered under a reduced pressure.

The thus prepared wet cake was mixed with 300 parts of ion-exchange water, and the mixture was agitated for 15 minutes with a TK HOMOMIXER mixer from Primix Corp., whose rotor was rotated at a revolution of 6,000 rpm, followed by filtration under a reduced pressure. Thus, a wet cake (a) was prepared.

The thus prepared wet cake (a) was mixed with 100 parts of a 10% aqueous solution of sodium hydroxide, and the mixture was agitated for 15 minutes with the TK HOMOMIXER mixer, whose rotor was rotated at a revolution of 6,000 rpm, followed by filtration under a reduce pressure. Thus, a wet cake (b) was prepared. The wet cake (b) was mixed with 100 parts of a 10% aqueous solution of hydrochloric acid, and the mixture was agitated for 15 minutes with the TK HOMOMIXER mixer, whose rotor was rotated at a revolution of 6,000 rpm, followed by filtration under a reduce pressure. Thus, a wet cake (c) was prepared. The wet cake (c) was mixed with 500 parts of ion-exchange water, and the mixture was agitated for 30 minutes with the TK HOMOMIXER mixer, whose rotor was rotated at a revolution of 6,000 rpm, followed by filtration under a reduced pressure to prepare a wet cake.

The thus prepared wet cake was dried for 24 hours at 40° C. using a circulating air drier, followed by sieving with a screen having openings of 75 μm.

Thus, a mother toner 7 of a black toner (black mother toner 7) having a weight average particle diameter of 5.2 μm and a Mw/Mn ratio of 1.14 was prepared.

One hundred (100) parts of the black mother toner 7 was mixed with 1.0 part of an external additive (silica, HDK-2000 from Clariant Japan K.K.) and 1.0 part of another external additive (silica, H05TD from Wacker Chemie AG) using a HENSCHEL MIXER mixer.

Thus, a black toner 7 was prepared.

(Preparation of Magenta, Cyan and Yellow Toners 7)

The procedure for preparation of the black toner 7 was repeated except that the black master batch 1 was replaced with the magenta master batch 1, cyan master match 1 or the yellow master batch 1.

Thus, magenta, cyan and yellow toners 7 were prepared.

Examples 1-6 and Comparative Examples 1-6

The transparent toner and the color toner used for each of Examples 1-6 and Comparative Examples 1-6 are described in Table 4 below.

TABLE 4

| | Transparent toner | Peak value of tan δ | Peak temperature (° C.) | Color toner (color) | Peak value of tan δ | Peak temperature (° C.) |
|---|---|---|---|---|---|---|
| Ex. 1 | 1 | 3.1 | 84 | 1 (Black) | 2.8 | 86 |
| Ex. 2 | 2 | 4.2 | 83 | 2 (Black) | 2.3 | 83 |
| Ex. 3 | 3 | 10.5 | 147 | 3 (Black) | 1.2 | 152 |
| Comp. Ex. 1 | 4 | 2.5 | 165 | 4 (Black) | 3.5 | 167 |
| Comp. Ex. 2 | 5 | 1.8 | 75 | 5 (Black) | 8.5 | 78 |
| Comp. Ex. 3 | 1 | 3.1 | 84 | 4 (Black) | 3.5 | 167 |
| Comp. Ex. 4 | 2 | 4.2 | 83 | 5 (Black) | 8.5 | 78 |
| Comp. Ex. 5 | 4 | 2.5 | 165 | 1 (Black) | 2.8 | 86 |
| Comp. Ex. 6 | 5 | 1.8 | 75 | 2 (Black) | 2.3 | 83 |
| Ex. 4 | 6 | 7.5 | 105 | 6 (Black) | 0.8 | 111 |
| Ex. 5 | 7 | 5.5 | 120 | 1 (Black) | 2.8 | 86 |
| Ex. 6 | 8 | 11.2 | 117 | 7 (Yellow) | 0.5 | 124 |
| | | | | 7 (Magenta) | 0.6 | 123 |
| | | | | 7 (Cyan) | 1.1 | 128 |
| | | | | 7 (Black) | 0.7 | 121 |

(Preparation of Developer Sets)

(Preparation of Carrier)

The following components were mixed and dispersed for 20 minutes by a HOMOMIXER mixer to prepare a carrier coating liquid.

| | |
|---|---|
| Silicone resin (organo-straight silicone) | 100 parts |
| Toluene | 100 parts |
| γ-(2-aminoethyl)aminopropyltrimethoxysilane | 5 parts |
| Carbon black | 10 parts |

A particulate Mn-ferrite having a weight average particle diameter of 35 μm serving as a core material was coated with the coating liquid and then dried using a fluidized bed coating device, in which the temperature of the fluidized bed was controlled so as to be 70° C. The coated core material was baked for 2 hours at 180° C. to prepare a carrier A.

(Preparation of Developer Sets)

Four (4) parts of each toner was mixed with 96 parts of the carrier A and the mixture was agitated for 5 minutes by a TURBULA MIXER mixer from Willy A. Bachofen AG., which was rotated at a revolution of 48 rpm.

Thus, developer sets for Examples 1-6 and Comparative Examples 1-6 were prepared.

The developer sets of Examples 1-6 and Comparative Examples 1-6 were evaluated with respect to the following properties.

1. Fixability (Low Temperature Fixability and Hot Offset Resistance)

Each of the developer sets was set in a printer IPSIO CX400 from Ricoh Co., Ltd., and solid images of the transparent toner and solid images of the color toner were produced on sheets of a recording material, MY PAPER from NBS Ricoh such that the color toner image is located on the transparent toner image. In this regard, the weight of the solid toner image was controlled so as to be 0.75±0.05 mg/cm$^2$. The combined solid toner images of the transparent toner and the solid images of the color toner were fixed using a copier IMAGIO NEO C600 while changing the fixing temperature to determine the cold offset temperature (i.e., minimum fixable temperature, below which a cold offset problem is caused) and the hot offset temperature (i.e., fixing temperature above which the hot offset problem is caused) of the combined solid toner images. The low temperature fixability of the combined toner images was evaluated by the minimum fixable temperature, and the hot offset resistance of the combined toner images was evaluated by the hot offset temperature.

The low temperature fixability was graded as follows.

A: The minimum fixable temperature is lower than 130° C. (Excellent)

B: The minimum fixable temperature is not lower than 130° C. and lower than 140° C.

C: The minimum fixable temperature is not lower than 140° C. and lower than 150° C.

D: The minimum fixable temperature is not lower than 150° C. and lower than 160° C.

E: The minimum fixable temperature is not lower than 160° C. (Bad)

The hot offset resistance was graded as follows.

A: The hot offset temperature is not lower than 201° C. (Excellent)

B: The hot offset temperature is from 191° C. to 200° C.

C: The hot offset temperature is from 181° C. to 190° C.

D: The hot offset temperature is from 171° C. to 180° C.

E: The hot offset temperature is not higher than 170° C. (Bad)

2. Glossiness Difference

The glossiness (60° glossiness) of each of the fixed color toner images, which were prepared above in the fixability evaluation test was measured with a gloss meter VGS-1D from Nippon Denshoku Industries Co., Ltd. In addition, the glossiness (60° glossiness) of each of the fixed combined solid toner images, which were prepared above in the fixability evaluation test, was measured with the gloss meter to determine the difference in glossiness between the fixed color toner image (without the transparent toner image) and the fixed combined toner image. The glossiness property of a combination of a color toner and a transparent toner is graded as follows.

A: The glossiness difference is not less than 40%. (Excellent)

B: The glossiness difference is from 30% to 39%.

C: The glossiness difference is from 20% to 29%.

D: The glossiness difference is not greater than 19%. (Bad)

The evaluation results are shown in Table 5 below.

TABLE 5

| | Color of the color toner | Low temperature fixability | How offset resistance | Glossiness difference |
|---|---|---|---|---|
| Ex. 1 | Black | A | B | B |
| Ex. 2 | Black | A | B | B |
| Ex. 3 | Black | B | A | B |
| Comp. Ex. 1 | Black | D | D | D |
| Comp. Ex. 2 | Black | B | E | D |
| Comp. Ex. 3 | Black | D | D | C |
| Comp. Ex. 4 | Black | B | E | C |
| Comp. Ex. 5 | Black | D | D | C |
| Comp. Ex. 6 | Black | B | E | C |
| Ex. 4 | Black | A | A | A |
| Ex. 5 | Black | A | A | A |
| Ex. 6 | Yellow | A | A | A |
| | Magenta | A | A | A |
| | Cyan | A | A | A |
| | Black | A | A | A |

It is clear from Table 5 that the developer sets of Examples 1-6 can produce glossy images at a relatively low fixing temperature without causing the hot offset problem.

As mentioned above, according to the image forming method, the image forming apparatus, and the process cartridge of the present invention, glossy images similar to photographic images can be formed at a relatively low fixing temperature without causing the hot offset problem and the preservation problem.

Additional modifications and variations of the present invention are possible in light of the above teachings. It is therefore to be understood that within the scope of the appended claims the invention may be practiced other than as specifically described herein.

What is claimed is:

1. An image forming method comprising:

forming an electrostatic latent image on an image bearing member;

developing the electrostatic latent image with a first developer including a color toner and a carrier, and a second developer including a transparent toner and a carrier to form a color toner image and a transparent toner image on the image bearing member;

transferring the color toner image and the transparent toner image to a recording material optionally via an intermediate transfer medium; and fixing the color toner image and the transparent toner image on the recording material, wherein the color toner includes a polyester resin and a colorant, and has a viscoelastic property such that loss tangent (tan δ) of the color toner, which is defined as a ratio (G")/(G') of loss modulus (G") to storage modulus (G'), has a maximum peak at a temperature of from 80° C. to 160° C., and is not greater than 3 at the maximum peak, and the transparent toner includes a crystalline polyester resin, and has a viscoelastic property such that loss tangent (tan δ) of the transparent toner has a maximum peak at a temperature of from 80° C. to 160° C., and is not less than 3 at the maximum peak.

2. The image forming method according to claim 1, wherein the loss tangent of the color toner is not greater than 2.5 at the maximum peak, and the loss tangent of the transparent toner is not less than 4 at the maximum peak.

3. The image forming method according to claim 1, wherein the transparent toner further includes a lubricant.

4. The image forming method according to claim 3, wherein the lubricant is a fatty acid amide-based lubricant, and is included in particles of the transparent toner.

5. The image forming method according to claim 4, wherein the fatty acid amide-based lubricant is N,N'-ethylene-bisstearamide.

6. The toner according to claim 3, wherein the lubricant is included inside the transparent toner in an amount of from 0.1 to 15 parts by weight per 100 parts by weight of a binder resin of the transparent toner including the crystalline polyester resin.

* * * * *